US007533656B2

(12) United States Patent
Dingle

(10) Patent No.: US 7,533,656 B2
(45) Date of Patent: May 19, 2009

(54) EXHAUST VALVE ARRANGEMENT AND A FUEL SYSTEM INCORPORATING AN EXHAUST VALVE ARRANGEMENT

(75) Inventor: Philip J. G. Dingle, Rochester, MI (US)

(73) Assignee: Delphi Technologies, Inc., Troy, MI (US)

( * ) Notice: Subject to any disclaimer, the term of this patent is extended or adjusted under 35 U.S.C. 154(b) by 42 days.

(21) Appl. No.: 11/634,666

(22) Filed: Dec. 6, 2006

(65) Prior Publication Data

US 2008/0135001 A1 Jun. 12, 2008

(51) Int. Cl.
*F02M 37/12* (2006.01)
*F02M 37/14* (2006.01)

(52) U.S. Cl. ..... 123/507; 123/58.9; 123/78 AA; 123/81 C; 123/188.5; 123/90.11

(58) Field of Classification Search ..... 123/507, 123/58.9, 188.5, 78 AA, 81 C, 90.11
See application file for complete search history.

(56) References Cited

U.S. PATENT DOCUMENTS 1,435,777 A * 11/1922 Williams, Jr. ..... 123/58.9
1,616,993 A * 2/1927 Heinrich ..... 123/65 VB
1,861,743 A * 6/1932 Hird, Jr. ..... 123/50 R
1,900,475 A * 3/1933 Winquist ..... 123/58.5
4,625,684 A * 12/1986 Van Avermaete ..... 123/48 A
5,113,805 A * 5/1992 Kawamura ..... 123/21
5,367,989 A * 11/1994 Peyer ..... 123/81 C
5,448,979 A * 9/1995 Clarke ..... 123/507
5,476,072 A * 12/1995 Guy ..... 123/48 AA
5,596,955 A * 1/1997 Szuba ..... 123/51 AA
6,199,541 B1 * 3/2001 Rogers ..... 123/507
2003/0226537 A1 * 12/2003 Schaich ..... 123/188.5

* cited by examiner

*Primary Examiner*—Erick Solis
(74) *Attorney, Agent, or Firm*—Thomas N. Twomey

(57) ABSTRACT

An exhaust valve arrangement for use in a combustion chamber of a compression ignition internal combustion engine, includes a piston which is movable outwardly from the combustion chamber in response to pressure generated within the combustion chamber as a result of combustion, and an outer sleeve within which the piston is movable. The outer sleeve is an exhaust valve which is actuable between open and closed positions to open and close, respectively, an exhaust passage from the combustion chamber. The exhaust valve arrangement further includes a pump chamber for receiving fluid, and a pumping plunger coupled to the piston and movable with the piston so as to pressurise fluid (e.g. fuel) within the pump chamber as the piston is urged outwardly from the combustion chamber. The pressure within the pump chamber is proportional to cylinder pressure and is sensed by a sensor which provides an output signal to an Engine Control Unit (ECU 16). An accumulator volume receives fluid that is pressurised within the pump chamber. Where the fluid is fuel, the accumulator volume is arranged to deliver fuel to one or more injectors of a common rail fuel injection system. Alternatively the accumulator volume may be arranged to deliver pressurised fluid to one or more engine systems e.g. for actuation purposes.

32 Claims, 13 Drawing Sheets

EXHAUST VALVE ARRANGEMENT AND A FUEL SYSTEM INCORPORATING AN EXHAUST VALVE ARRANGEMENT

TECHNICAL FIELD

The invention considers improvements relating to combustion engine technology and, in particular, compression ignition (diesel) internal combustion engine technology. It is a particular feature of the invention to provide an improved fuel system incorporating an improved exhaust valve arrangement. The invention also relates to the exhaust valve arrangement itself.

BACKGROUND TO THE INVENTION

During the combustion cycle of the engine, a piston reciprocates in known fashion within a cylinder which defines a combustion chamber into which an injection of fuel is provided to initiate the combustion process. The combustion chamber is closed, at its upper end, by a cylinder head which defines a so-called fire deck of the cylinder. Current diesel engines are likely to have four valves per cylinder; two intake valves and two exhaust valves. The valves normally take the form of mushroom-headed poppet valves which, when closed, seat against the fire deck of the cylinder and, when open, project into the cylinder. The valves are referred to as inward opening as they open into the combustion chamber. Such poppet valves are common place and their design parameters are well understood. However, it is one negative aspect of their operation that the exhaust valve is obliged to open against considerable cylinder pressure under certain full load running conditions, and also during engine braking operation. For this reason the valve train must be more robust than would otherwise be the case. Furthermore, by virtue of opening into the cylinder, the opportunity to provide charge scavenging during the intake/exhaust valve overlap period is severely restricted due to the probability of piston-to-valve collision unless clearance scallops are incorporated into the crown of the cylinder piston or the fire deck. However, these scallops have been found to degrade combustion through inhibition of desirable in-cylinder air swirl.

There have been many developments in diesel engine technology in recent years, in particular relating to improvements to the combustion process itself. Currently, the diesel engine combustion process can be described as heterogeneous and diffusion based, although the prevailing trend now is to move towards a premixed auto-ignition model of some type. The various advanced combustion modes may be characterised by, among other things, the lack of a positive initiator for the start of combustion, the requirement for relatively high levels of dilution of the charge with exhaust gas and the undesirable generation of high rates of cylinder pressure rise (dp/dt) resulting in excessive noise and structural stress. Under premixed combustion conditions, unacceptable values in the range of 10 to 35 bar/crank angle degree have been recorded for cylinder pressure rise rate, whereas a value of perhaps 5 bar/crank angle degree would be considered a normal maximum. Although advanced combustion modes provide benefits for efficiency and emissions, the aforementioned characteristics in particular present problems for which solutions are sought.

By way of example, U.S. Pat. No. 5,476,072 describes a cylinder head construction which is intended to address the stress induced by high rates of pressure rise in a valveless 2-stroke spark ignition engine.

Increasingly, fuel injection systems of the common rail type are specified for new diesel engines. In such systems a multi-piston pump raises fuel pressure to a level that is suitable for injection directly into the engine combustion chamber. Typically, the system includes a high pressure pump having a cam drive arrangement, an accumulator volume or rail, one injector per engine cylinder and an electronic control unit (ECU) for controlling injection timing and other parameters. The high pressure pump is a complex, heavy and costly component, and although common rail systems provide benefits over more traditional fuel injection systems (e.g. distributor pumps, unit pumps), there are significant implications on engine design with respect to the location of the high pressure pump and its drive arrangement. In particular, the drive torque signature can include "spikes" which make the pump and its drive a leading source of undesirable noise, vibration and harshness.

By way of background to the invention, the prior art in the following patent literature is acknowledged: U.S. Pat. Nos. 4,244,342 and 4,394,856 describe compression-pressure operated pumps combined with injector units, GB 465263 describes a compression-pressure operated pump for pressurising fuel for injection, and GB 590628 describes a fuel system where the pressure in one cylinder of the engine is used to pressurise lubricating oil for another cylinder of the engine.

It is an object of the invention to provide an improvement to known fuel systems which reduces or overcomes at least one of the aforementioned disadvantages associated with current systems. It is a further object of the invention to provide a novel exhaust valve arrangement for use in such fuel systems.

SUMMARY OF THE INVENTION

According to a first aspect of the invention there is provided an exhaust valve arrangement for use in a combustion chamber of a compression ignition internal combustion engine having a cylinder head, the exhaust valve arrangement including a piston which is movable outwardly from the combustion chamber in response to pressure generated within the combustion chamber as a result of combustion, and an outer sleeve which is mountable within the cylinder head and within which the piston is movable, in use. The outer sleeve is actuable between open and close positions to open and close, respectively, an exhaust passage from the combustion chamber, thereby to provide an exhaust valve function.

It is one benefit of the invention that the piston is moved outwardly from the combustion chamber in controlled response to pressure peaks that occur within the chamber as a result of rapid combustion. This provides an advantage over existing systems where no provision is made to absorb rapid pressure increases, a problem that is particularly evident during premixed combustion and/or high load conditions. In the present invention, a controlled increase in the combustion chamber volume can occur in unison with rapid gas expansion as the piston is urged outwardly from the combustion chamber. This is possible because the response rate of the light and dynamically mobile piston is better able to follow the high rates of pressure rise than is the case for the main cylinder piston. The rate of pressure increase in the combustion chamber is therefore moderated.

A further advantage of the invention is that the flow of exhaust gas through the open valve arrangement into the exhaust passage is not obstructed. In a conventional arrangement, where the exhaust valve opens into the combustion chamber, the head of the valve and its stem tend to impede the exhaust gas flow. The cylinder head exhaust valve bore can therefore be machined with a smaller diameter than conventional systems, if desired, whilst still allowing the same exhaust flow. Furthermore, with an outwardly opening exhaust valve arrangement there is no requirement to form clearance cut-outs in the piston crown or fire deck which may otherwise disrupt in-cylinder air swirl to the detriment of efficient combustion.

Preferably, the piston cooperates with the outer sleeve so as to urge the outer sleeve into the closed position in which it closes the exhaust passage. In one example, a piston spring serves to urge the piston into a position in which the piston holds the outer sleeve closed against the seat. With the piston in this position, its lower surface lies flush with a fire deck (ceiling) of the combustion chamber, which is defined by the cylinder head.

In another embodiment, a gas or fluid pressure may act on the piston to urge the piston into a position in which the piston holds the outer sleeve closed.

In an alternative embodiment a "wave washer" or similar is provided between the piston and the outer sleeve so as to minimise impact noise and wear. Alternatively, a compliant material may be substituted which both minimises impact noise and provides a seal between the piston and the outer sleeve to minimise compression gas leakage past the piston when they are in the rest position.

In a particularly preferred embodiment, the piston is hollow. A hollow piston is relatively lightweight. In addition, as the piston is hollow, it can be at least partially filled with a heat transfer material (e.g. sodium salts) which serves to aid heat transfer away from the face of the piston that is exposed to the combustion chamber.

In one preferred embodiment, the piston includes a main piston body in the form of a cup and a piston cap. The piston cap closes the cup so that they are securely attached, one to the other. In this case the piston spring may act on the cap of the piston.

In a preferred embodiment, the outer sleeve has an actuator for moving the outer sleeve into the open position in which the exhaust passage is open and unobstructed. By way of example, the actuator may be coupled to the outer sleeve via a mechanical linkage (e.g. a conventional cam and pushrod mechanism). Preferably, the actuator is electromagnetic in nature and under control from the ECU.

It is a benefit of the outer sleeve that it is pressure balanced, and therefore only a relatively low actuation force is required to move the outer sleeve between its closed position, in which the exhaust passage from the combustion chamber is closed, and its open position in which the exhaust passage from the combustion chamber is open. Furthermore, it will be appreciated that only hoop stresses are induced in the outer sleeve, and no axial stresses.

The outer sleeve can be moved to open the exhaust passage only in circumstances in which the piston has previously been urged to open, against the biasing spring force, due to pressure within the combustion chamber.

The exhaust valve arrangement may further comprise a pump chamber for receiving fluid, wherein a surface associated with the piston defines a wall of the pump chamber so that the piston pressurises fluid within the pump chamber as the piston is urged outwardly from the combustion chamber.

For example, the piston may be coupled to a pumping plunger which defines the wall of the pump chamber. The pumping plunger is movable in unison with the piston in response to pressure generated within the combustion chamber so as to pressurise fluid within the pump chamber.

A particularly preferred embodiment of the invention therefore provides an exhaust valve arrangement for use in a combustion chamber of a compression ignition internal combustion engine, including a piston which is movable outwardly from the combustion chamber in response to pressure generated within the combustion chamber as a result of combustion, an outer sleeve within which the piston is movable, wherein the outer sleeve is operable between open and closed positions to open and close, respectively, an exhaust passage from the combustion chamber, a pump chamber for receiving fluid, and a pumping plunger movable with the piston in response to pressure generated within the combustion chamber so as to pressurise fluid within the pump chamber as the piston is urged outwardly from the combustion chamber.

According to a second aspect of the invention, there is provided a fuel system for a compression ignition internal combustion engine, the fuel system comprising an exhaust valve arrangement including a piston which is movable outwardly from the combustion chamber in response to pressure generated within the combustion chamber as a result of combustion and an outer sleeve within which the piston is movable, wherein the outer sleeve is operable between open and closed positions to open and close, respectively, an exhaust passage from the combustion chamber. The fuel system further includes a pump chamber for receiving fluid and a pumping plunger movable with the piston in response to pressure generated within the combustion chamber. A valve assembly is arranged to control the supply of fluid to and from the pump chamber, whereby the valve assembly is operable to allow pressure spikes within the combustion chamber to be absorbed by movement of the plunger.

Preferably, the fuel system includes at least one fuel injector for delivering fuel into the combustion chamber. The fuel system may further include an accumulator volume for receiving fluid that is pressurised within the pump chamber.

In a preferred embodiment, the fluid within the pump chamber is fuel and the accumulator volume is arranged to store fuel for delivery to the or each injector.

The fuel system of the invention provides the benefit that, as the piston is coupled to the plunger, movement of the piston, which results directly from the combustion process, may be used to pressurise fuel within the pump chamber for delivery to the injector(s). The system therefore removes the need for a separate high pressure fuel pump, with its associated drive arrangement, for pressurisation purposes.

The fuel system may further comprise a rail control valve for controlling communication between the pump chamber and the accumulator volume. The rail control valve is preferably operable by means of an electromagnetic actuator under the control of an Engine Control Unit (ECU). For example, the fuel system may be a hybrid common-rail-EUI fuel system of the type described in the Applicant's granted patents U.S. Pat. Nos. 6,966,301 and 684,305.

Preferably, the rail control valve is pressure balanced with respect to the pump chamber pressure acting on it so that only a relatively low actuation force is required to move it.

In a further preferred embodiment, the fuel system may include means for sensing the pressure in the pump chamber, which is also proportional to cylinder pressure, whereby the rail control valve is actuated at a timing which is intended to coincide with the start of combustion to open communication between the pump chamber and the accumulator volume. In one embodiment, for example, the rail control valve is actuated in response to the sensed pressure.

In engines operating in an advanced premixed combustion mode (e.g. Homogeneous Charge Compression Ignition (HCCI) combustion), the provision of the pressure sensor is considered essential as it can provide an indication of when combustion is about to occur based on the low-temperature heat release indications. When the engine is operating under conventional late injection combustion modes, the requirement for a pressure sensor is not essential as it is normally possible to predict the start of combustion timing from its close relationship to the start of main fuel injection timing.

A non-return valve is preferably provided between the rail control valve and the accumulator volume. The non-return valve acts to trap high pressure fuel within the accumulator volume.

The fuel system further comprises a filling valve for controlling the supply of low pressure fuel to the pump chamber.

In one embodiment, the filling valve is an actuable valve which can be controlled by the ECU. If the filling valve is actuable (i.e. there is control over when the valve is opened and closed), it is possible to continue engine operation even in the event of misfire, for example, as described further below.

It may be most convenient to operate the filling valve by means of an electromagnetic actuator.

Preferably, the filling valve is pressure balanced with respect to the pump chamber pressure acting on it so that only a relatively low actuation force is required to move it.

In another embodiment, however, the filling valve is a spring-biased non-return valve.

For economy of manufacture, the rail control valve and the filling valve are both movable within a common bore formed in a valve housing that may be integral with the accumulator volume.

The invention also has application to so-called intensifier injector systems such as those described in the Applicant's co-pending European patent application EP1552139 A1 and in Caterpillar Inc.'s granted patent U.S. Pat. No. 5,191,867. For example, in one particular embodiment the fluid within the pump chamber is fuel which is delivered to a dedicated injector. The area ratio of the piston to the plunger is such that fuel within the pump chamber is pressurised to only a relatively low injection level. The injector is provided with an intensifier arrangement (e.g. as in EP 1552139) which serves to increase the relatively low injection pressure of fuel (e.g. in the range 250 to 600 bar) within the pump chamber, as provided by the plunger/piston, to an intensified or higher level (e.g. 1600 to 2600 bar). This system provides the benefit that injection can occur at one of at least two different pressure levels.

According to a third aspect of the invention, there is provided a fuel system for a compression ignition internal combustion engine, the fuel system including at least one fuel injector for delivering fuel into the combustion chamber and first and second exhaust valve arrangements, each of which includes an associated piston which is movable outwardly from the combustion chamber in response to pressure generated within the combustion chamber as a result of combustion, an associated outer sleeve within which the associated piston is movable, wherein the associated outer sleeve is operable between open and closed positions to open and close, respectively, an associated exhaust passage from the combustion chamber, an associated pump chamber for receiving fluid, and a pumping plunger coupled to the associated piston and movable with the associated piston so as to pressurise fluid within the pump chamber as the associated piston is urged outwardly from the combustion chamber.

In one particular embodiment of the invention, one of the exhaust valve arrangements of the fuel system pressurises fuel which is ultimately delivered to the fuel injector, whereas another of the exhaust valve arrangements of the system, which has similar features to the first referenced exhaust valve arrangement, is used to pressurise a fluid for a different purpose. For example, the pump chamber of the second exhaust valve arrangement is arranged to receive a fluid other than fuel at relatively low pressure. Fluid within the pump chamber of the second exhaust valve arrangement is pressurised in response to movement of the second piston and is delivered to a second accumulator volume. Fluid within the second accumulator volume is delivered to an engine system such as, for example, an electro-hydraulic variable valve actuation system or a hydraulically assisted turbo-charger boost device.

In another embodiment, the pump chamber of the second exhaust valve arrangement is arranged to receive fuel. The fuel within the pump chamber of the second exhaust valve arrangement is pressurised in response to movement of the piston of the second exhaust valve arrangement and is therefore arranged to deliver the pressurised fuel to a second accumulator volume uniquely associated with the second exhaust valve arrangement. If the second accumulator volume stores pressurised fuel, this fuel may also be used to active a hydraulically intensified injector as described above.

In one example, in the first exhaust valve arrangement an area ratio of the piston to the pumping plunger is greater than the corresponding area ratio of the piston to the pumping plunger in the second exhaust valve arrangement. Thus, fuel that is pressurised within the pump chamber of the first exhaust valve arrangement, for supply to the injector, is pressurised to a higher level than fuel that is pressurised within the pump chamber of the second exhaust valve arrangement.

Fuel that is pressurised to the lower level within the pump chamber of the second exhaust valve arrangement and delivered to the second accumulator volume can be used with a suitably equipped injector for the purpose of injecting fuel into the combustion chamber for injection events where high pressure is neither required nor desired, such as an early premixed injection of fuel, a pilot or post injection of fuel, or an injection of fuel for after treatment dosing purposes or similar.

In another embodiment, the first and second exhaust valve arrangements may be arranged to pressurise fuel to substantially the same pressure level which is then supplied to a common accumulator volume (e.g. common rail) to be provided to a plurality of injectors of the engine.

According to a fourth aspect of the invention, there is provided a method of determining the pressure of gas within the combustion chamber of a compression ignition internal combustion engine, comprising transmitting a force that is generated as a result of the pressure of gas within the combustion chamber to an associated plunger and pressurising fluid within a pump chamber by means of the associated plunger. The method further comprises sensing the pressure of fluid within the pump chamber by the pressure sensing means, and determining an indication of the combustion pressure from an output signal of the pressure sensing means.

The pump chamber is a hydraulically locked-off chamber.

BRIEF DESCRIPTION OF THE DRAWINGS

The invention will now be described, by way of example only, with reference to the accompany figures in which.

DETAILED DESCRIPTION OF PREFERRED EMBODIMENTS

Figure 1:
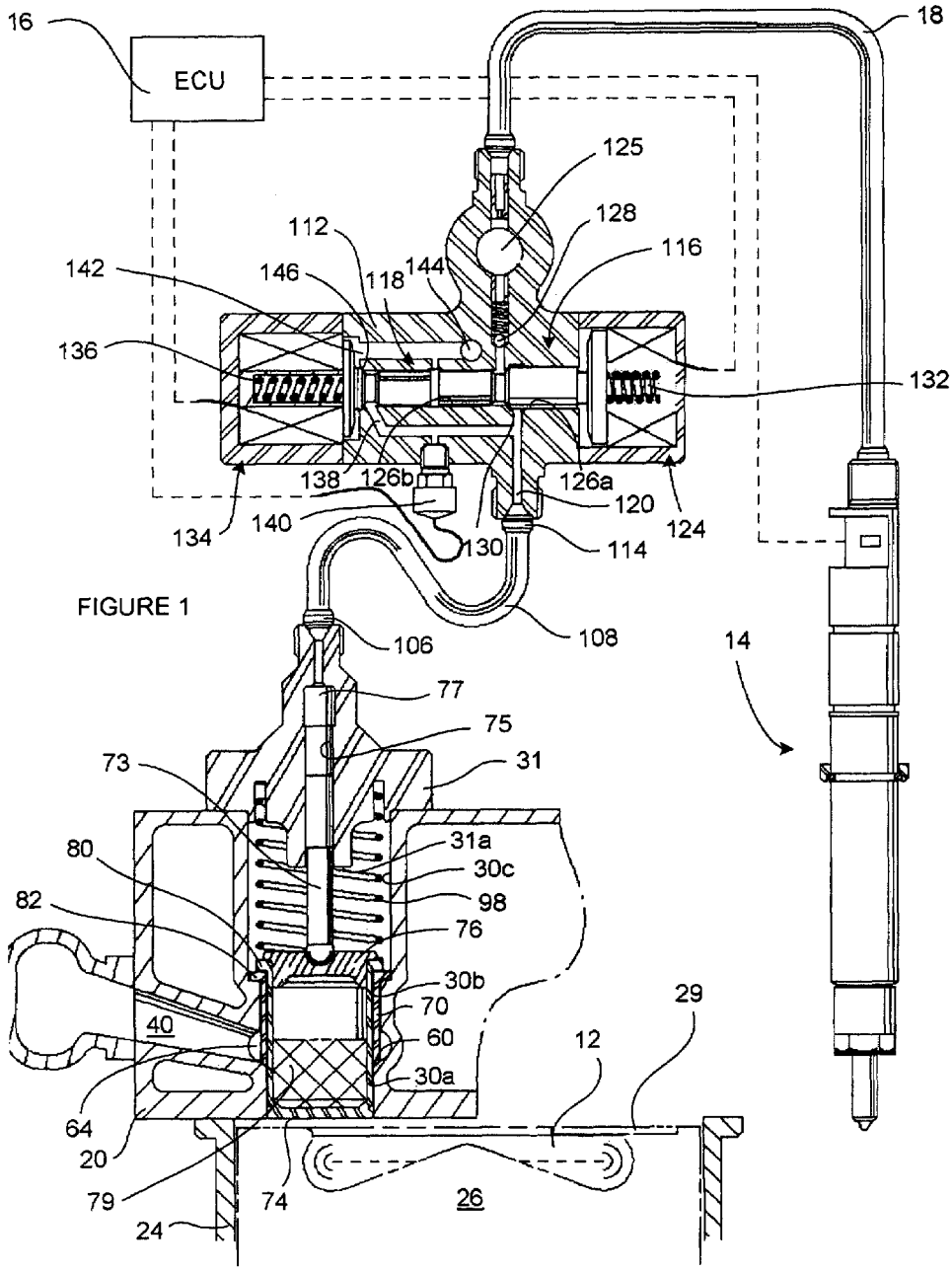
FIG. 1 is a schematic view of a fuel system of one embodiment of the invention, including an exhaust valve arrangement and an electromagnetically operable filling valve.

Referring to FIG. 1, an engine cylinder for an internal combustion engine of the compression ignition (diesel) type defines a combustion chamber 12 into which combustible fuel is injected. In general, the engine is provided with a plurality of cylinders, but for simplicity only one of the cylinders will be described here. The combustion chamber 12 has an associated fuel injector 14 which is arranged to inject fuel at relatively high pressure into the combustion chamber 12 under the control of an Engine Control Unit (ECU) 16. The injector 14 receives pressurised fuel for injection through from a supply passage 18.

The engine cylinder has a cylinder head 20 which defines an upper ceiling of the combustion chamber 12, typically referred to as the fire deck 22. A cylinder piston 26 is driven, in use, by a crank shaft of the engine within a cylinder sleeve 24. The cylinder piston 26 is provided with a recess or crown in its upper surface to define a piston bowl which forms a lower boundary of the combustion chamber 12. A cut out 29 is provided on the upper surface of the right side of the cylinder piston 26, as will be described in further detail later.

Figure 2:
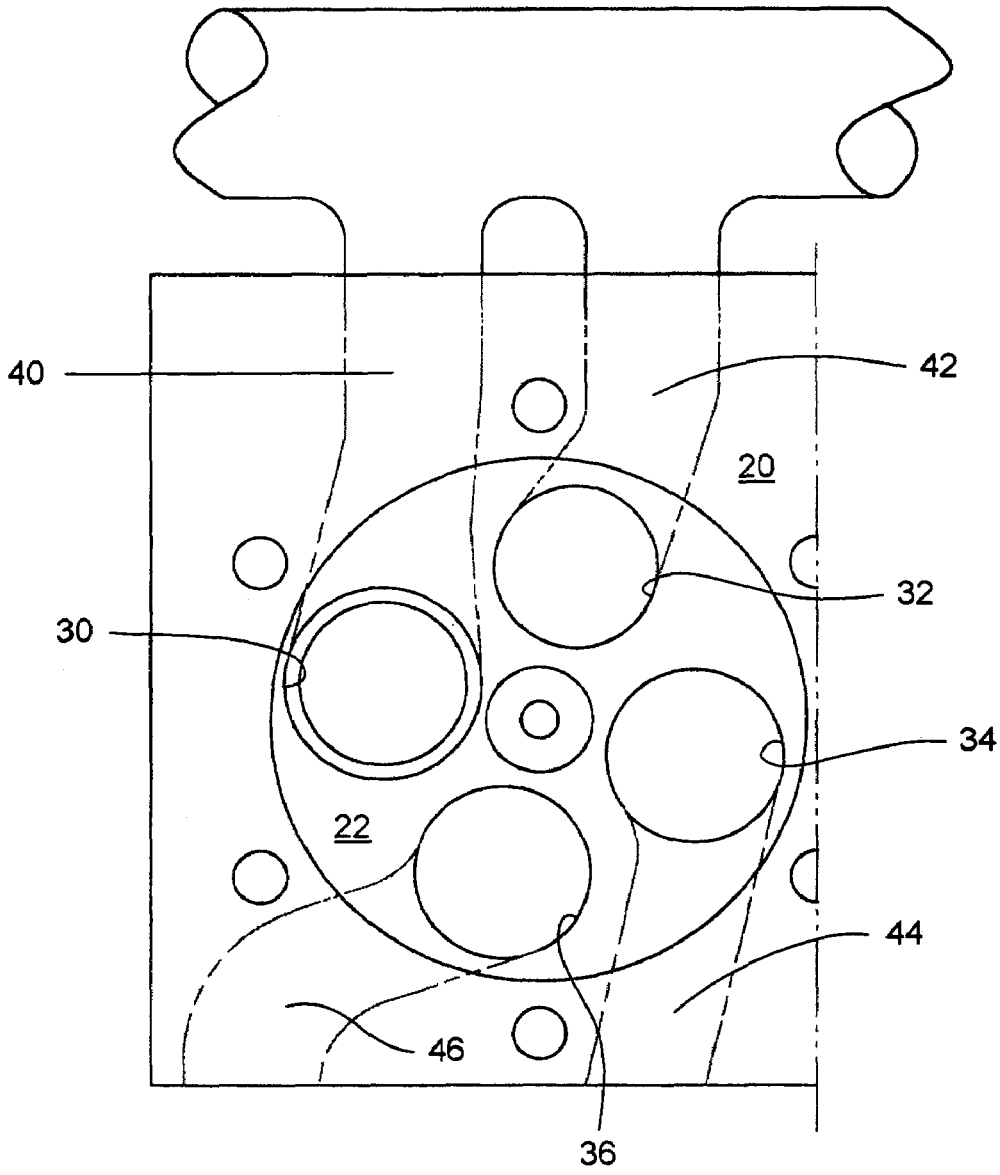
FIG. 2 is a plan view of a cylinder head of an engine cylinder of the fuel system in FIG. 1.

Referring to FIG. 2, the cylinder head 20 is provided with first, second, third and fourth bores, 30, 32, 34, 36 respectively, each of which houses a respective valve arrangement. The valve arrangements may provide a variable valve actuation (VVA) function, as is known in the art. Each of the first and second bores 30, 32 houses an exhaust valve arrangement (not shown in FIG. 2) to allow combustion gases resulting from the combustion process to be expelled from the combustion chamber 12. Each of the third and fourth bores 34, 36 houses an intake valve arrangement (not shown in FIG. 2) through which air flows into the combustion chamber 12. Each of the exhaust and intake valve arrangements has an associated intake or outlet passage 40, 42, 44, 46 from which combustion gases are supplied from, or air is supplied to, the combustion chamber 12, through the associated one of the valves.

The construction and operation of engine intake valves would be well understood by persons familiar with engine technology and so the details will not be described further here.

Figure 3:
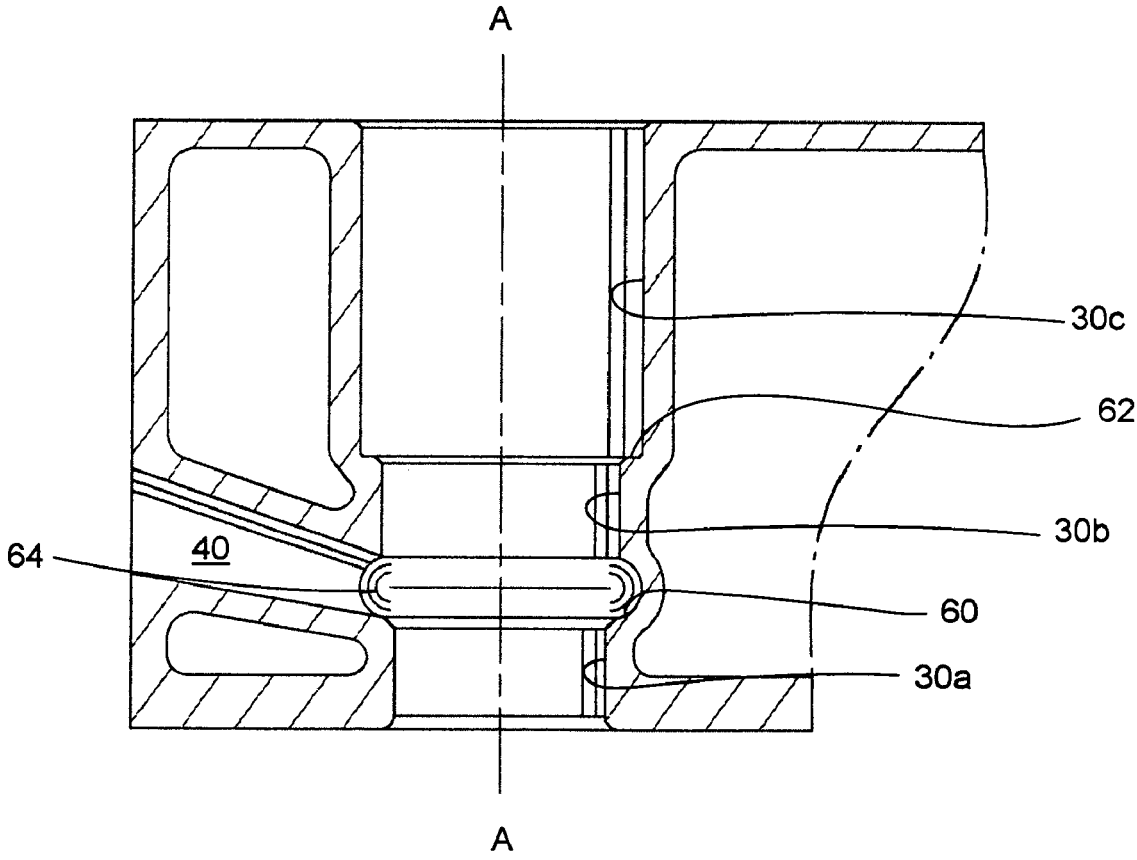
FIG. 3 is a section view of a part of FIG. 1 to illustrate a bore for the exhaust valve arrangement, but with the exhaust valve arrangement removed.

For simplicity, only one of the exhaust valve arrangements 50 will be described here, with reference to FIGS. 1 and 3.

The first bore 30 provided in the cylinder head 20 is stepped to define a lower bore region 30*a*, a middle bore region 30*b* and an upper bore region 30*c*, the lower bore region 30*a* having a smaller diameter than the middle bore region 30*b* and the middle bore region 30*b* having a smaller diameter than the upper bore region 30*c*. Therefore, a first step or seat 60 is defined at the interface between the lower and middle bore regions 30*a*, 30*b* and a second step or shelf 62 is defined at the interface between the middle and upper bore regions 30*b*, 30*c*. The exhaust valve arrangement 50 is received mainly within the lower and middle bore regions 30*a*, 30*b*, as can be seen in FIG. 1. The upper bore region 30*c* is closed by a housing 31 mounted on the upper surface of the cylinder head 20. The lower, middle and upper bore regions 30*a*, 30*b*, 30*c* are concentric along on axis A-A and, as such, are convenient to machine. An enlarged annular bore region 64 is provided at the interface between the lower and middle bore regions 30*a*, 30*b*. The enlarged annular bore region 64 opens into the exhaust passage 40 which extends generally laterally from the centreline axis A-A to the exterior of the cylinder head, as may be seen in FIG. 2.

Figure 4:
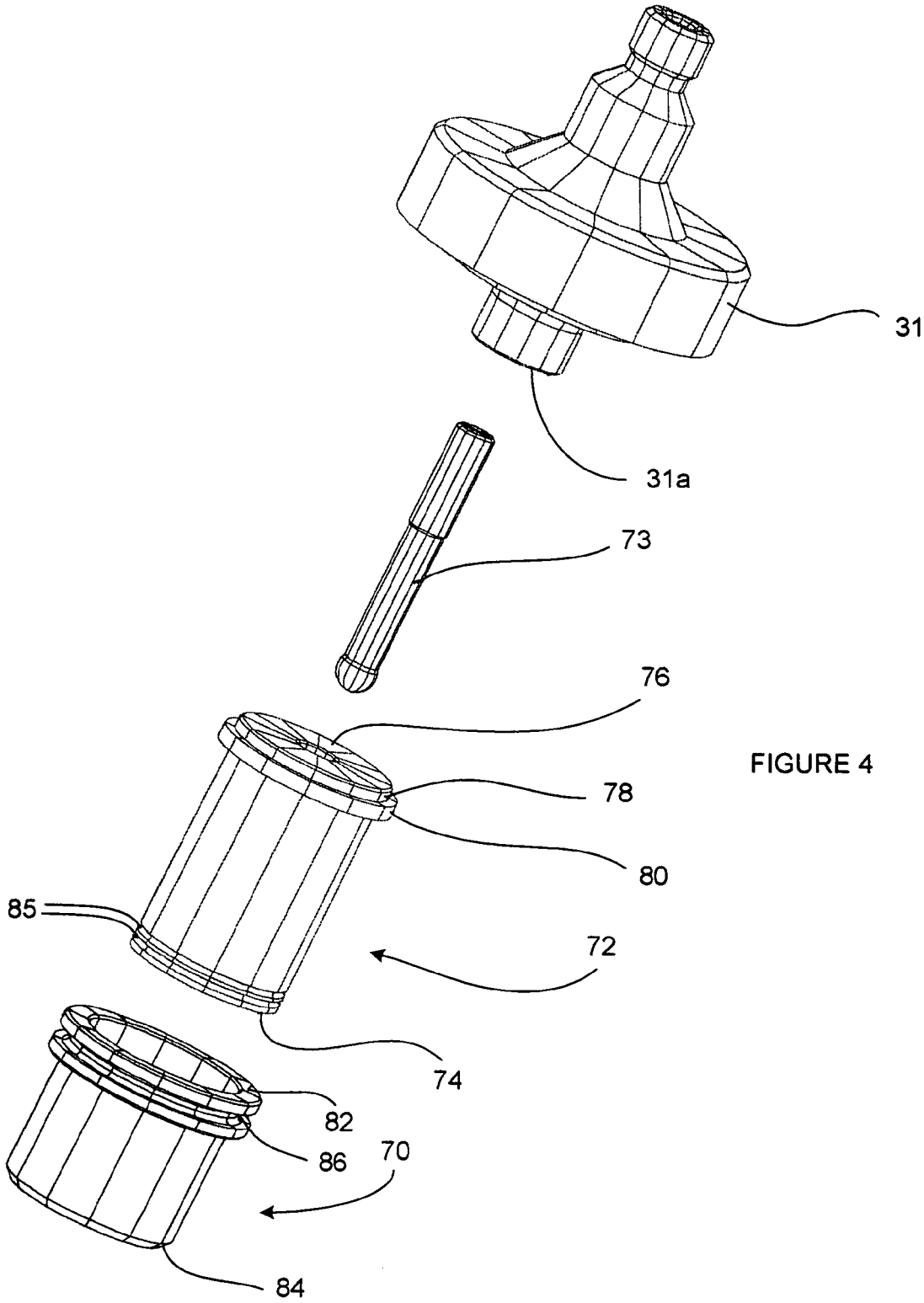
FIG. 4 is an exploded view of an outer sleeve, a piston, a plunger and a housing of the exhaust valve arrangement in FIG. 1.

Referring also to FIG. 4, the exhaust valve arrangement 50 includes an exhaust valve in the form of an outer sleeve or cuff 70 within which a piston 72 is received in a movable manner. The piston 72 is movable within the outer sleeve 70 under the influence of gas pressure within the combustion chamber 12 which results from the combustion process. The piston 72 is of longer length than the outer sleeve 70 and takes the form of a hollow cup having, at its closed lower end, a lower external surface 74 which is exposed to gases within the combustion chamber 12.

The outer sleeve 70 is movable within the middle bore region 30*b* in the cylinder head 20 and the lower end of the outer sleeve 70 defines a frusto-conical surface 84 which is engageable with the seat 60 to control the flow of exhaust gas from the combustion chamber 12 to the exhaust passage 40 as the outer sleeve 70 moves. When the outer sleeve 70 is seated on the seat 60, there is a gas-tight seal between the outer sleeve 70 and the seat 60. The upper end of the outer sleeve 70 carries an annular lip 82.

The piston 72 includes a main piston body having an annular lip 80 at its upper end. At the lower end of the main piston body, labyrinth grooves 85 extend circumferentially around the outer surface of the piston 72 so as to minimise the escape of cylinder pressure past the piston 72, in use. As an alternative, a piston ring could be used on the piston 72 for this purpose.

The hollow interior of the piston 72 is closed at its upper end by a piston cap 76. The piston cap 76 includes a lower portion (not visible in FIG. 4) which is received within the hollow body of the piston 72, and an upper portion, of enlarged diameter, which defines an annular lip 78 which seats upon the annular lip 80 on the main piston body. In the illustration shown in FIG. 1, the outer sleeve 70 is seated against the first seat 60, at the frusto conical surface 84, and the annular lip 80 of the piston 72 is engaged with the annular lip 82 of the outer sleeve 70.

The cap 76 of the piston 72 is in mechanical connection with a further piston or pumping plunger 73 which projects into the housing 31 mounted on the upper surface of the cylinder head 20. Measures are contemplated to minimise the transfer of heat from the piston 72 into the pumping plunger 73 at their interface. The housing 31 has a lower surface 31*a* and is provided with a further bore 75, within which the pumping plunger 73 is received. A seal (not shown) elastomeric or similar, may be provided for the plunger 73 or the housing 31 to minimise fuel leakage into the chamber within the upper bore region 30*c*. An end surface of the pumping plunger 73 defines, together with the further bore 75, a pump chamber 77 for receiving fuel.

Figure 5:
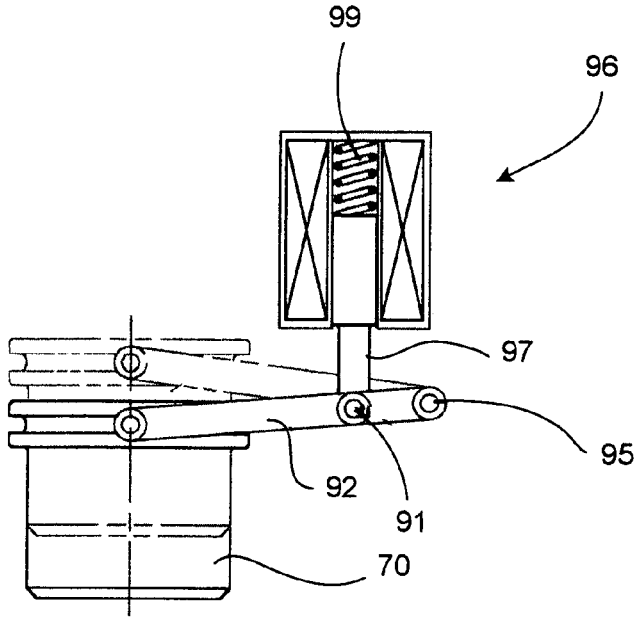
FIG. 5 is a schematic view of the outer sleeve in FIG. 4 together with an actuator for the sleeve.
Figure 6:
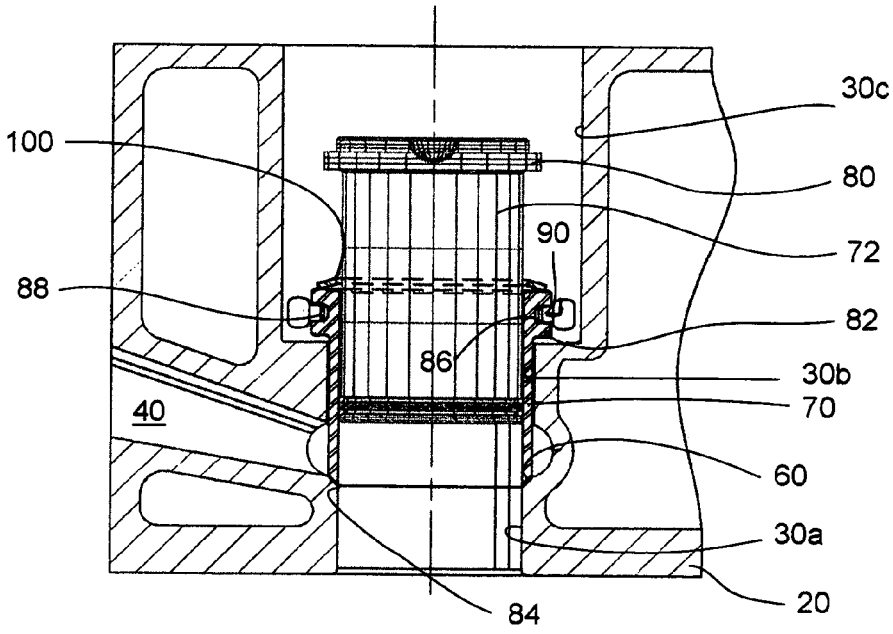
FIG. 6 is a schematic view taken in a plane at 90° to that of FIG. 5 of the outer sleeve in FIGS. 4 and 6, when in a closed position.

Referring also to FIGS. 5 and 6, the annular lip 82 at the upper end of the outer sleeve 70 is provided with an annular groove 86 within which first and second connecting pins 88, 90 are received at diametrically opposite positions. The first and second connecting pins 88, 90 are attached, via respective first and second connecting arms (only one of which, 92, is visible in FIG. 5), to a solenoid or other electrically controlled actuator 96. The first connecting arm 92 links, via a link point 91, to a further link member 97 to the actuator 96 and, in use, pivots about a fulcrum 95. A fulcrum and link point (not shown) are provided for the second connecting arm in a similar manner. A resilient component such as a spring 99 is employed to preferentially bias the outer sleeve 70 and its actuating mechanism 88, 90, 91, 92, 95, 96, 97 into the closed position where the lower surface 84 of the outer sleeve 70 is engaged with the seat 60. As illustrated by the dashed lines in FIG. 5, when the actuator 96 is energised the outer sleeve 70 is caused to move vertically within the middle bore 30*b* so as to allow the lower surface 84 of the outer sleeve 70 to be disengaged from the seat 60.

In FIG. 6 it can be seen that, as an optional feature, a resilient component 100, such as a wave or Belleville washer, rests upon the annular lip 82 of the outer sleeve 70, interposed between the lip 82 and the annular lip 80 of the piston 72. This ensures that a soft landing is obtained when the piston 72 comes to rest on the outer sleeve 70.

The piston 72 is able to move within the outer sleeve 70 between a first (rest) position in which the external surface 74 of the piston 72 lies approximately flush with the fire deck 22, and a second (maximum lift) position in which the piston 72 has moved outwardly from the combustion chamber, within the bore of the outer sleeve 70, to clear the exhaust passage 40. The lower surface 31*a* of the housing 31 defines a stop for the piston 72 in its maximum lift position.

In another embodiment, it is contemplated that a resilient component such as a polymer material may be provided at the seating interface between the cap 76 of the piston 72 and the lower surface 31*a* of the housing 31 to minimise impact noise and wear.

In the rest position of the piston 72, the lower surface 84 of the outer sleeve 70 is seated on the seat 60. The outer sleeve 70 is urged into this rest position by means of the spring 99 which acts on the actuator 96 (as shown in FIG. 5). Additionally, a piston spring 98 is located within the upper region 30*c* of the bore 30. The housing 31 defines, on its lower surface, an abutment for one end of the piston spring 98, the other end of which abuts the upper surface of the lip 80 of the piston 72. The piston spring 98 therefore acts through the piston 72, which is thereby caused to sit on the outer sleeve 70 via its annular lip 82 (and through the intermediate resilient washer 81, if provided). With the piston 72 and the outer sleeve 70 in their respective rest positions, no exhaust gas is able to flow out of the combustion chamber 12 into the exhaust passage 40. By actuating the actuator 96 when the piston 72 is in or moving towards the maximum lift position, the outer sleeve 70 is caused to lift from the seat 60 so as to permit exhaust gas to flow to the exhaust passage 40.

The provision of the piston spring 98 ensures the piston 72 remains in a position in which its lower surface 74 lies flush with the fire deck 22 for that period of the combustion cycle when pressure in the combustion chamber 12 is relatively low (i.e. prior to combustion). It is against this spring force that the piston 72 moves when it is subjected to the forces due to combustion pressure within the combustion chamber 12.

Optionally, the hollow piston 72 is partially filled with sodium salts or similar material 79 to aid heat transfer away from the lower face 74 of the piston 72 to the cylinder head 20, in use. For example, sodium salts is solid at relatively low temperature but it melts as it heats up to conduct heat away from the lower face 74 of the piston 72 through the walls of the piston 72, through the sleeve 70 to the cylinder head 20. The piston 72 is preferably made from a ceramic material (e.g. silicon nitride) having a low coefficient of thermal expansion so as to minimise the risk of the piston 72 becoming stuck in the outer sleeve 70 on cold start-up. The piston 72 could also, if manufactured from metal, be coated with a hard, low friction diamond-like carbon coating to minimise friction as it moves within the outer sleeve 70. The outer surface of the outer sleeve 70 may also be provided with a similar coating. As the piston 72 is hollow, it is of relatively low weight.

As can be seen most clearly in FIG. 1, the pump chamber 77 has an inlet/outlet 106 port which is connected with one end of a connecting flow passage 108 which, at its other end, communicates with an inlet/outlet port 114 of a control valve arrangement. The control valve arrangement has a valve housing 112 and comprises two valve assemblies, a rail control valve assembly, referred to generally as 116, and a filling valve assembly, referred to generally as 118, both of which are controlled by the ECU 16.

A first passage 120 within the valve housing 112 communicates with the connecting passage 108. A second passage 122 within the valve housing 112 communicates with the first passage 120 under the control of the rail control valve assembly 116 and is arranged to deliver fuel to an accumulator volume 125 (referred to as the rail volume 125) defined within the valve housing 112. In the preferred embodiment, the accumulator volume 125 is integrated with the valve housing 112 which may be mounted external to the cylinder head or may be mounted under the engine's valve cover (also referred to as the rocker cover). Other arrangements, including integrating the valve housing 112 within the housing 31 are also contemplated.

The second passage 122 is provided with a non-return or check valve 128, located between the rail control valve assembly 116 and the rail volume 125. Via the non-return valve 128, the rail control valve assembly 116 provides a means for controlling communication between the connecting flow passage 108, and hence the pump chamber 77, and the rail volume 125. The rail volume 125 is connected to the injector 14 by the supply passage 18 and, optionally, may be connected to the supply passage for one or more other injectors of the engine.

Figure 7:
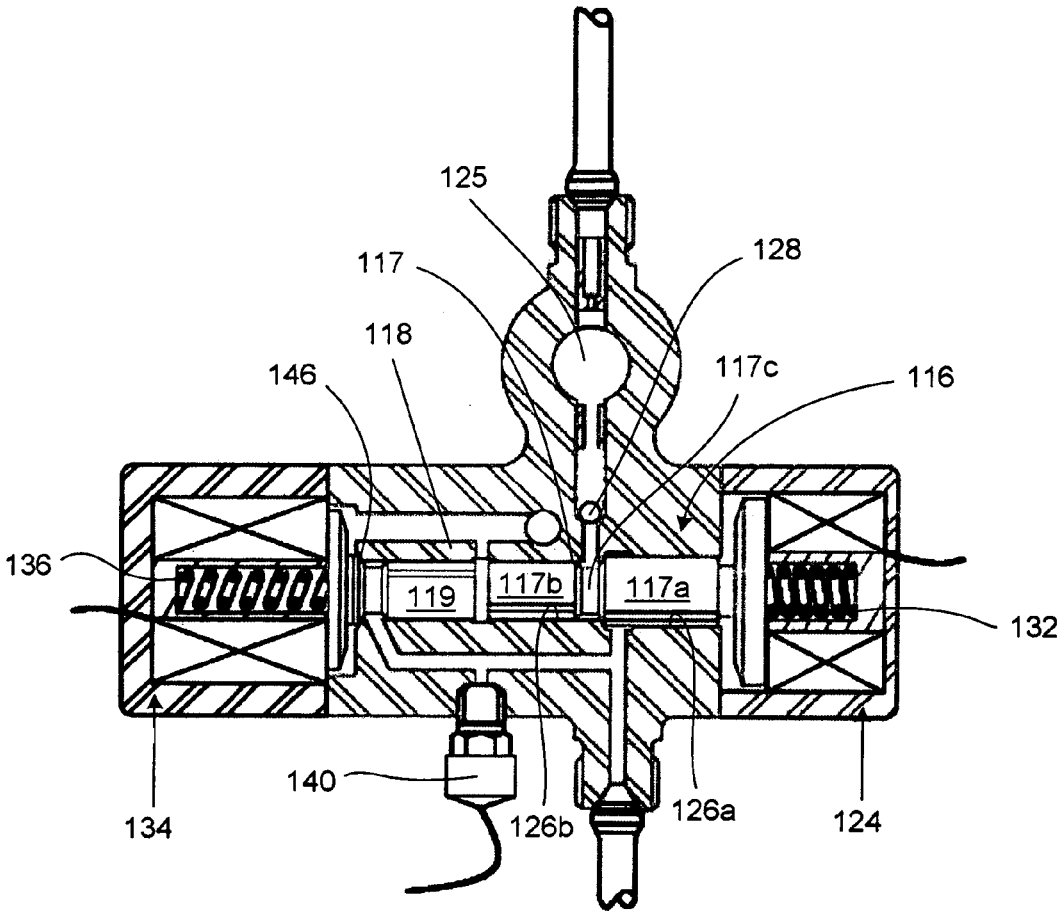
FIG. 7 is an enlarged view of the rail control valve of the fuel system in FIG. 1.

Referring also to FIG. 7, the rail control valve assembly 116 is operable under the control of a rail control valve actuator 124 to move between an open position in which a rail control valve pin 117 of the assembly is spaced from a valve seat 130 and a closed position in which the rail control valve pin 117 is seated against the valve seat 130. The rail control valve actuator 124 is a solenoid or other electrically operated actuator. A rail control valve spring 132 serves to urge the rail control valve pin 117 into its closed position.

The rail control valve pin 117 includes an enlarged diameter region 117*a* and a reduced diameter region 117*b* joined by a neck region 117*c*. The enlarged and reduced diameter regions 117*a,* 117*b* of the rail control valve pin 117 are movable within bores 126*a,* 126*b,* respectively, provided in the valve housing 112. The first passage 120 terminates in an annulus within the valve housing 112, at the neck 117*c* of the rail control valve pin 117, which opens into the enlarged bore 126*a*. In this region, the enlarged diameter region 117*a* of the rail control valve pin 117 seats on the valve seat 130 to interrupt communication between the first and second passages 120, 122. To the left of the valve seat 130 (in the orientation shown in FIGS. 1 and 7), the annulus defined at the neck 117*c* of the rail control valve pin 117 communicates with the second passage 122. The rail control valve pin 117 is pressure balanced so that only a relatively low actuation force is required to move it between the closed and open positions.

In use, when the rail control valve actuator 124 is de-actuated, the rail control valve pin 117 is held against the valve seat 130 under the force of the rail control valve spring 132 so as to close communication between the first and second passages 120, 122. When the rail control valve actuator 124 is actuated, the rail control valve pin 117 is caused to move to the right (in the orientation shown in FIGS. 1 and 7), against the force of the spring 132, so as to open communication between the first and second passages 120, 122.

The filling valve assembly 118 includes a pressure-balanced filling valve pin 119 which is received within the same bore 126*b* as the reduced diameter region 117*b* of the rail control valve pin 117 and is movable towards and away from a filling valve seat 146. The filling valve pin 119 is movable by means of a filling valve actuator 134, being a solenoid or other electrically controlled actuator, to move between open and closed positions. A filling valve spring 136 serves to urge the filling valve pin 119 into its closed position in which it seats against the valve seat 146.

The valve housing 112 is also provided with a branch passage 138 which connects the first passage 120 with a region of the bore 126*b* below the filling valve seat 146. The branch passage 138 is provided with a pressure sensor 140 which provides an output signal to the ECU 16 to influence the timing for operating the rail control valve assembly 116, as discussed further below. A low pressure passage 142 in the valve housing 112 communicates with a low pressure fuel supply gallery 144 which is supplied with fuel by a remote pump (not shown) at a pressure of around 5 bar. The gallery 144 also communicates, via a communicating passage 143, with a central annulus 145 located between the filling valve pin 119 and the reduced diameter region 117*b* of the rail control valve pin 117. Fuel leakage past the guide diameters for the valves 117*b,* 119 collects within the central annulus 145, and hence passes to the low pressure fuel gallery 144. In a similar manner, a drilling (not shown) is also provided in the valve housing 112 so as to provide a return path to the low pressure fuel gallery 144 for fuel leakage between the enlarged bore region 126*a* for the rail control valve pin 117.

The filling valve pin 119 is operable to control whether the branch passage 138 communicates with the low pressure passage 142 or whether communication between the branch passage 138 and the low pressure passage 142 is closed.

In use, when the filling valve actuator 134 is de-actuated, the filling valve pin 119 is held against the filling valve seat 146 by means of the filling valve spring 136 and communication between the branch passage 138 and the low pressure passage 142 is closed. When the filling valve actuator 134 is actuated, the filling valve pin 119 is caused to move to the left (in the orientation shown in FIG. 1), against the force of the filling valve spring 136, so that communication between the branch passage 138 and the low pressure passage 142 is open.

Operation of the fuel system will now be described in further detail for a four stroke combustion cycle.

For the purpose of the following description, it helps to appreciate that the combustion cycle typically includes four phases corresponding to four strokes of the cylinder piston: an intake (induction) stroke, a compression stroke, a power (expansion) stroke and an exhaust stroke. The invention is applicable to combustion cycles having a different number of strokes (e.g. two, six, eight) but for simplicity only a four stroke combustion cycle will be considered here.

Figure 8:
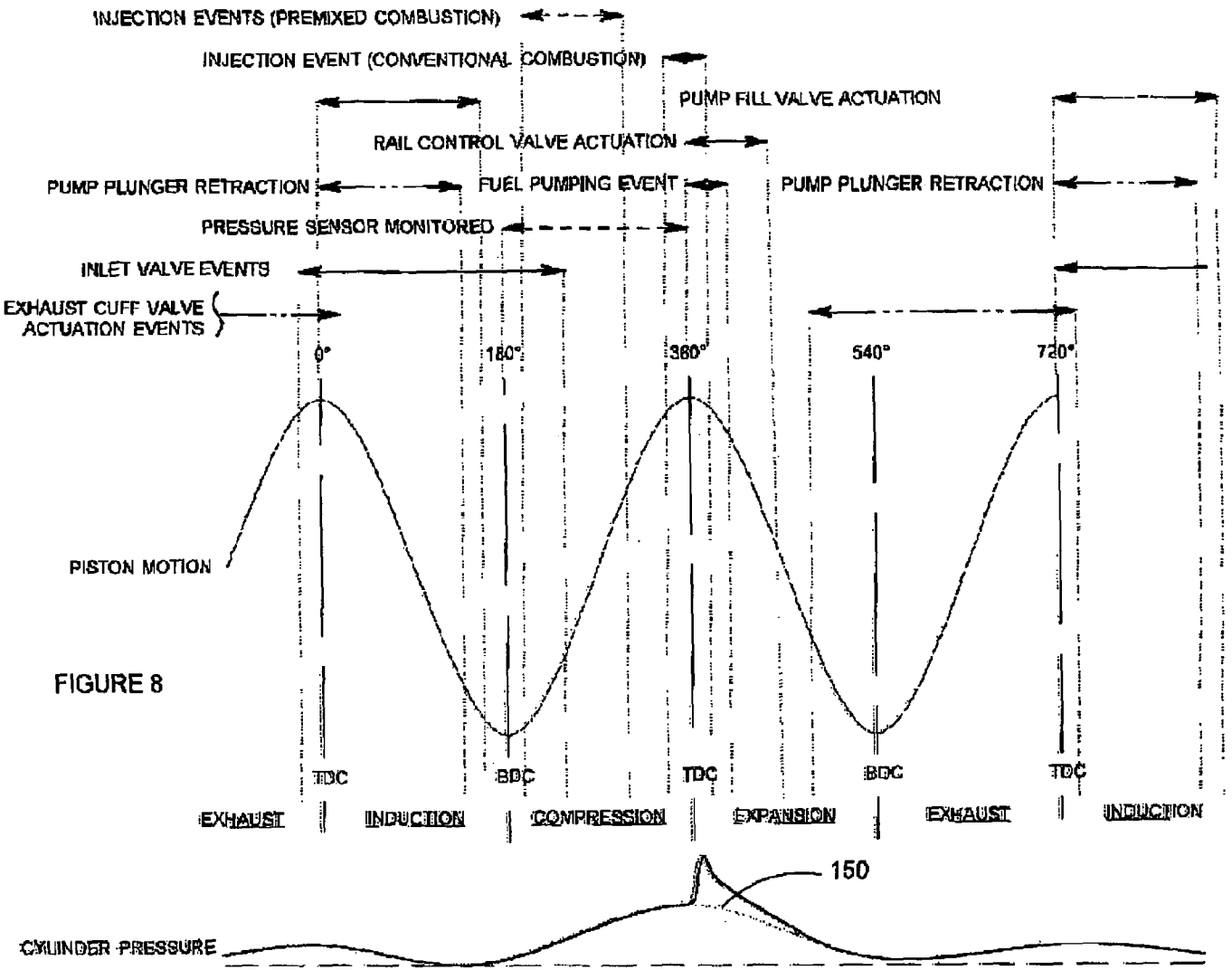
FIG. 8 is a timing diagram to illustrate operation of the fuel system in FIG. 1 throughout a combustion cycle, FIGS. 9(*a*), (*b*) and (*c*) illustrate three operating states of the exhaust valve arrangement in FIG. 1.

FIG. 8 illustrates a four stroke combustion cycle: induction, compression, power and exhaust. The time base is engine crankshaft position (degrees of rotation), moving from left to right.

On the intake stroke, the cylinder piston 26 is moved outwardly from the combustion chamber 12, moving between top dead centre (TDC) and bottom dead centre (BDC), and the intake valves are caused to open. Typically, the exhaust valves are closed at this time. Air is drawn into the cylinder through the open intake valves through suction, or under boost pressure, together with recirculated exhaust gas from the EGR system.

During the compression stroke, the cylinder piston 26 is driven inwardly towards the cylinder head 20, between BDC and TDC, reducing the volume above the cylinder piston 26. The exhaust valves remain closed at this time. The intake valves start to close shortly after the cylinder piston 26 commences the compression stroke. As the cylinder piston 26 moves inwardly within the combustion chamber 12 during the compression stroke, air in the combustion chamber 12 is compressed and air temperature increases significantly.

When the cylinder piston 26 is nearing the top of its stroke (TDC), fuel is injected into the combustion chamber 12 and starts to burn (auto-ignite), starting the combustion process. The heat released as a result of the combustion process causes pressure in the combustion chamber 12 to increase.

The pressure increase acts on the cylinder piston 26, driving the piston away from the cylinder head 20, between TDC and BDC, to increase the force on the crankshaft for the power stroke. Towards the end of the power stroke, the exhaust valves are caused to open and, for the subsequent exhaust stroke as the cylinder piston 26 is driven inwardly within the cylinder sleeve 24, towards the cylinder head 20, exhaust is expelled through the open exhaust valves to the exhaust passage 40.

Figure 9A:
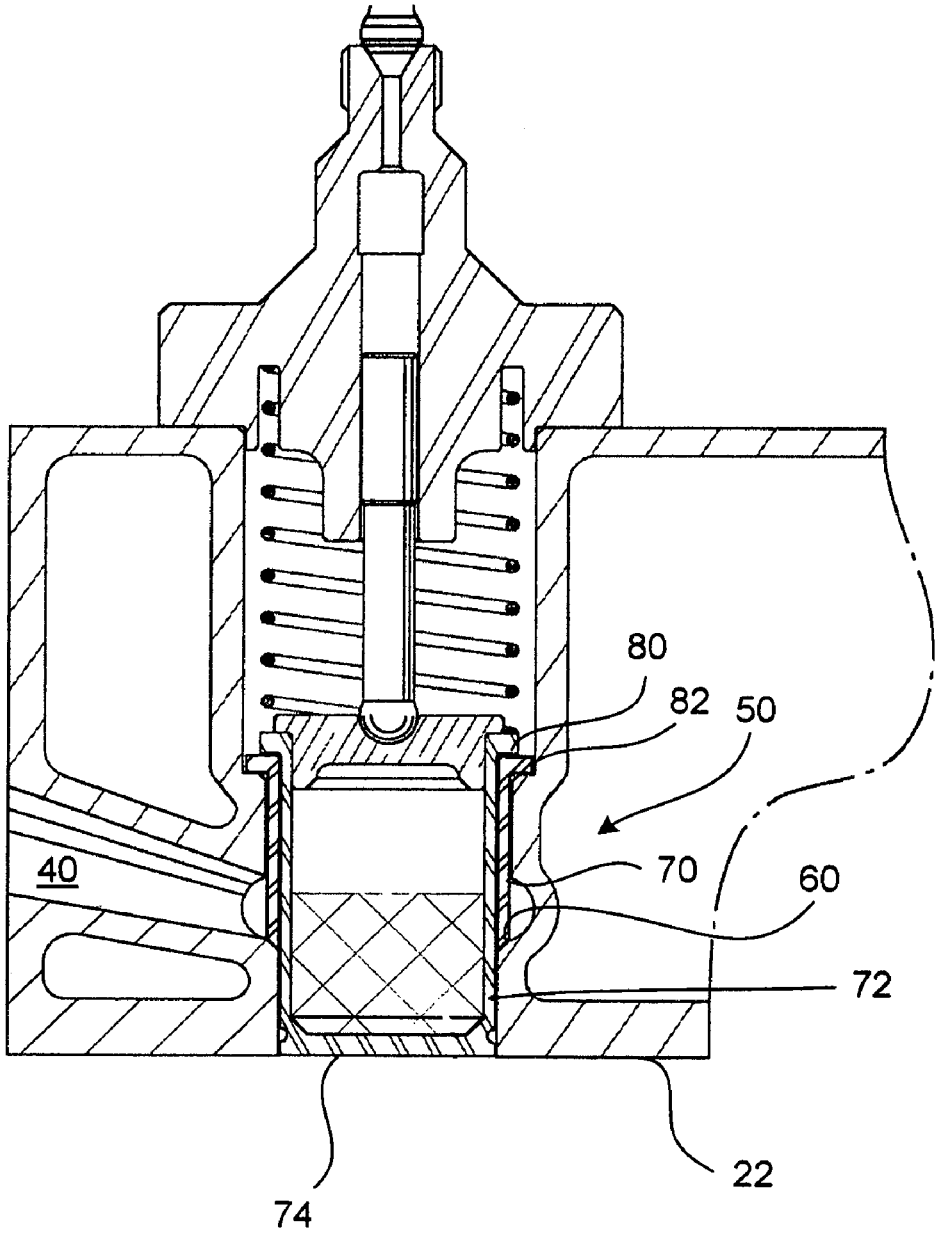
Figure 9B:
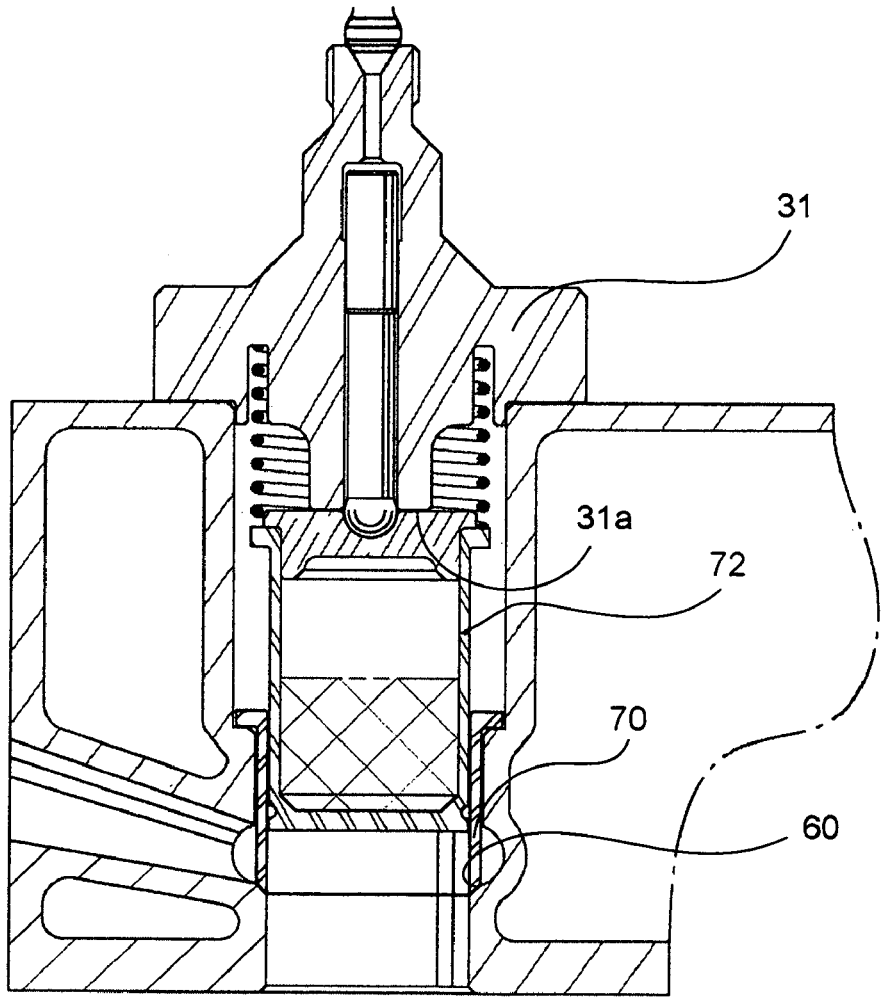
Figure 9C:
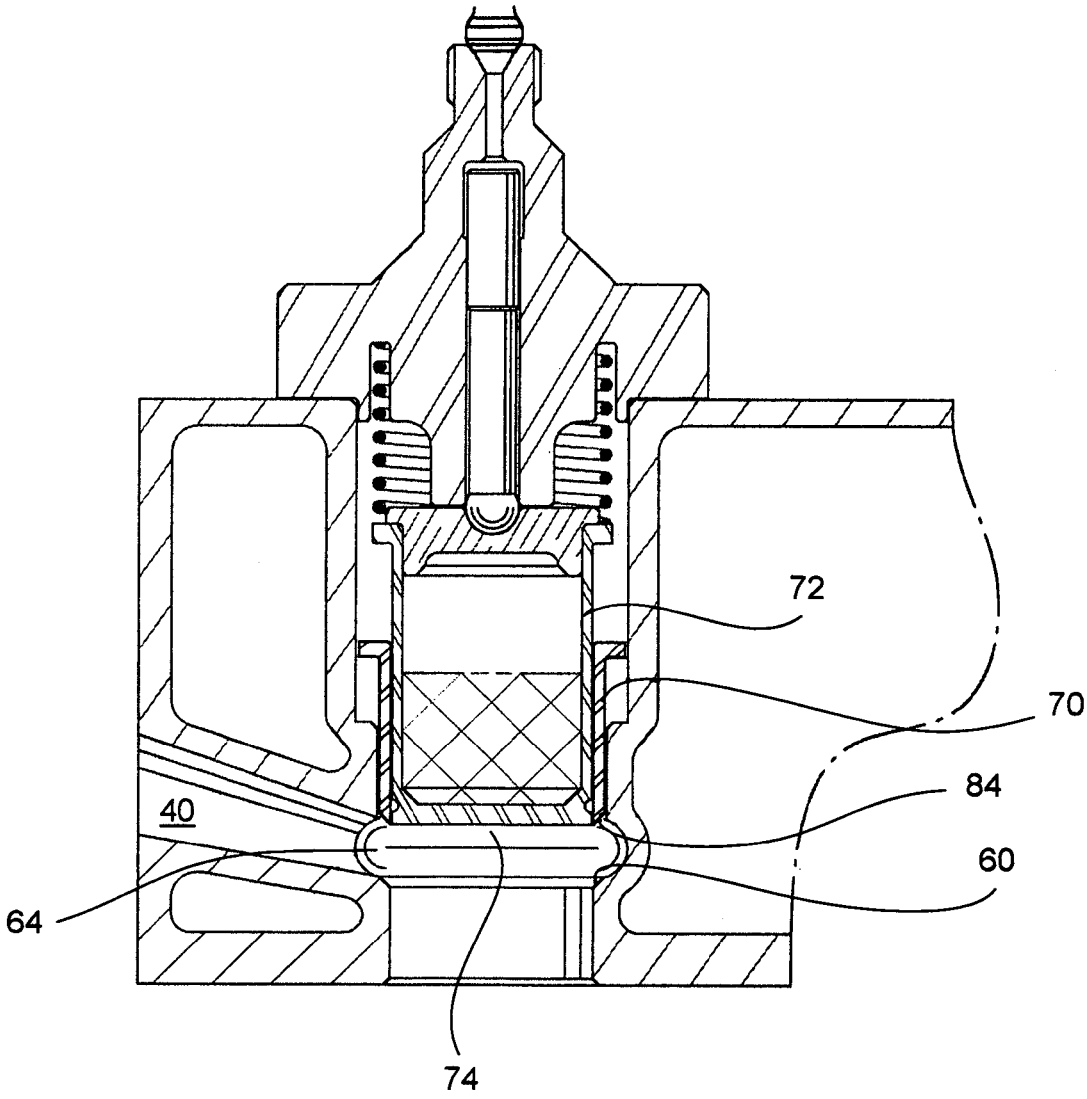

There now follows a description of the operation of fuel system in FIG. 1, with further reference to FIGS. 8 and 9(*a*), (*b*) and (*c*). The timing of opening and closing of the rail control valve pin 117 and the filling valve pin 119 is illustrated in the timing diagram of FIG. 8, together with a representation of cylinder pressure. It is assumed that the operating strategy is an advance premixed combustion mode e.g. HCCI.

At or around the start of the intake stroke, the filling valve pin 119 is actuated by the actuator 134 so that the low pressure passage 142 is brought into communication with the branch passage 138. The rail control valve assembly 116 is in a closed state so that the pin 117 is on its seat 130 and communication between the first and second passages 120, 122 is closed. Fuel at high pressure from the preceding cycle has therefore been trapped in the rail volume 125 due to the non-return valve 128, which is also closed.

During the intake stroke, with the cylinder piston 26 moving away from the cylinder head 20, the intake valves are opened and air is drawn into the combustion chamber 12.

The piston 72 is urged, by means of the piston spring 98, into the position in which its lower surface 74 lies flush with the fire deck 22. The annular lip 80 at the upper end of the piston 72 abuts the annular lip 82 at the upper end of the outer sleeve 70 so that the outer sleeve 70 is held against the seat 60. The exhaust passage 40 is therefore closed. This is the position of the exhaust valve arrangement shown in FIG. 9(*a*).

As the piston 72 is urged towards its rest position under the force of the piston spring 98, the pumping plunger 73 retracts from the pump chamber 77 causing low pressure fuel to be drawn from the low pressure supply 144, past the open filling valve pin 119 and into the pump chamber 77 via the connecting flow passage 108. Once the piston 72 has reached its rest position, with the annular lip 80 in abutment with the seated outer sleeve 70, the filling valve pin 119 is closed, at or near the end of the intake stroke.

The cylinder piston 26 then performs the compression stroke, during which fuel is injected into the cylinder via the injector 14 to initiate the power stroke. The rail control valve pin 117 remains seated throughout both the intake stroke and the compression stroke.

More specifically, the effective compression ratio is controlled by modulating the point in the cycle at which the intake valves are closed, using the VVA capability of the system and based upon feedback from the ECU from the previous combustion event. The objective is to influence the premixed combustion so that auto-ignition occurs after the cylinder piston 26 has reached TDC, and not before as is the natural tendency for a premixed charge. By closing the intake valves either earlier or later than normal, a less than full charge of air is trapped and this determines the resulting compression temperature and pressure.

During the compression stroke, and depending on the particular injection strategy chosen, multiple small injections of fuel may be introduced by the injector 14 to the combustion chamber 12 to produce a lean homogeneous charge. If the quantity and temperature of the EGR have been controlled accurately, the fuel has mixed homogeneously and the compression pressure is as predicted, the combustion chamber charge will auto-ignite spontaneously and concurrently throughout the combustion chamber resulting in a rapid increase in pressure just after TDC.

During the compression stroke, rapidly increasing pressure within the combustion chamber 12 acts upon the lower surface 74 of the piston 72 and causes the piston 72, acting through the cap 76 and the plunger 73, to pressurise fuel within the pump chamber 77 in proportion to cylinder pressure. It will be appreciated that the pump chamber 77 is part of a hydraulically locked volume comprising the passages 108, 120 and 138, due to the rail control valve pin 117 and the filling valve pin 119 being closed.

The pressure sensor 140 senses the pressure in the branch passage 138 (and hence in the pump chamber 77) and, in response to the pressure signal, the ECU 16 actuates the rail control valve assembly 116 to open communication between the first and second passages 120, 122. The rail control valve assembly 116 is opened at or very close to TDC once the ECU 16 determines the imminent onset of the auto-ignition combustion, via the signal from the pressure sensor 140.

It is a particular feature of the invention that, at the start of the power stroke just after TDC, the piston 72 is caused to move outwardly from the combustion chamber 12 into its maximum lift position as a result of the high temperature, and hence pressure, within the combustion chamber 12 due to rapid oxidation of the fuel (rapid combustion). This is the position of the exhaust valve arrangement in FIG. 9(*b*), with the piston 72 moved into abutment with the lower surface 31*a* of the housing 31 (its maximum lift position) but with the outer sleeve 70 still seated against the seat 60.

As the piston 72 is moved into its maximum lift position, the pumping plunger 73 is forced into the pump chamber 77 to reduce its volume. This causes fuel within the pump chamber 77 to be pressurised still further and pumped through the connecting passage 108.

The low weight of the piston 72 ensures that it is responsive to the high rates of pressure rise (dp/dt) that occur upon auto-ignition. As a result of the piston 72 moving outwardly from the combustion chamber 12, the combustion chamber volume is increased concurrent with the rapid increase in cylinder pressure. The effect of dynamic modification of the combustion volume during the main combustion event is to moderate the rate of pressure increase with respect to time, and so noise and structural stress in the cylinder head 20 is reduced.

With the rail control valve assembly 116 open, pressurised fuel in the pump chamber 77 is displaced through the connecting flow passage 108, into the first and second passages 120, 122. When fuel pressure within the passages 120, 122 exceeds that within the rail volume 125, the non-return valve 128 is caused to open so that fuel within the pump chamber 77 is able to flow past the open rail control valve pin 117 and the open non-return valve 128 into the rail volume 125.

The spring-loaded non-return valve 128 will close once the flow from the pump chamber 77 has abated, trapping the displaced high pressure fuel within the rail volume 125. At this time also, the rail control valve solenoid 124, under the control of the ECU 16, is deactivated to allow the rail control valve pin 117 to return to its seat 130, thus interrupting communication between the first and second passages 120, 122 and isolating the rail volume 125 from the pump chamber 77.

In the event that rail pressure, as determined by the rail pressure sensor (not shown) is at its target value so that no additional charging of the accumulator 125 is required, the rail control valve assembly 116 may remain deactivated and the filling valve assembly 118 may be actuated instead so that fluid displaced by the plunger 73 from the pump chamber 77 may be discharged through the passages 108, 120, 138, into the low pressure gallery 144. To prevent heavy metal to metal impact between the piston cap 76 and the stop-face 31*a* at the end of stroke due to the rapid displacement of the piston 72, the filling valve assembly 118 can be deactuated to close the valve pin 119 against its seat 146 just before full stroke is reached so that the combination of the piston 72 and the plunger 73 are arrested instead by hydraulic lock in the communicating passages 108, 120, 138.

Fuel at high pressure that is trapped within the rail volume 125 can be delivered via the supply passage 18 to the injector 14, or other injectors similarly connected to the rail volume 125, for subsequent injections.

During the exhaust stroke that follows the power stroke, and with the piston 72 in its maximum lift position, the outer sleeve 70 is actuated so that it lifts from the seat 60, thereby allowing a flow of exhaust gas past the seat 60 into the exhaust passage 40. The maximum lift position for the outer sleeve 70 is reached when the lower edge of the surface 84 has moved to a position in which it is at or slightly above the top of the enlarged annular bore region 64 and is thus coincident with the lower surface 74 of the raised piston 72. In this position, the surface 74 of the piston 72 acts as the roof of the enlarged annular bore region 64, and neither the piston 72 nor the outer sleeve 70 cause obstruction to the exiting flow of exhaust gas. This is the position of the exhaust valve arrangement shown in FIG. 9(*c*). In order to improve the coefficient of discharge for the exit of the vitiated exhaust gases, a small radius or chamfer may be applied to the junction between the fire deck 22 and the inlet to the cylinder head bore region 30*a*.

At the end of the exhaust stroke when pressure within the cylinder 12 is low, the actuator 134 is energised so as to cause the filling valve pin 119 to disengage from its seat 146 so that fresh fuel from the gallery 144 may enter the passages 138, 120, 108 via the low pressure passage 142, thereby replenishing the pump chamber 77 as the piston 72 returns to its rest position. As the piston 72 returns to its rest position, so too does the outer sleeve 70 (as in FIG. 9(*a*)) under the control of the actuator 96. In the process of so-doing, the pumping plunger 73 retracts from the pump chamber 77. The filling valve pin 119 is opened at this time under the control of the ECU 16 so that fuel starts to fill the pump chamber 77, ready for the next combustion cycle. The piston 72 is therefore urged back into its rest position under the force of the piston spring 98, acting in combination with filling pressure on the pumping plunger 73.

Continued operation is possible in the event of misfire or other situation where the fuel pressure generated in the pump chamber 77 by combustion chamber pressure does not exceed the pressure of fuel within the rail volume 125. In this situation, it is still necessary to exhaust the spent cylinder gases, and so movement of the piston 72, and hence of the outer sleeve 70, can be enabled by energising the filling valve assembly 118, and not the rail control valve assembly 116, to thus allow both the piston 72 and the outer sleeve 70 to move into their fully raised positions, as in FIG. 9(*c*).

It will be appreciated from the foregoing description that the system utilises movement of the piston 72 under gas pressure within the combustion chamber 12 to pressurise the fuel that is injected by the injector 14. The need for a separate costly and bulky high pressure fuel pump can therefore be avoided, whilst retaining the recognised benefits of a common rail injection system with its flexibility of injection timing and pressure control. This method of generating injection pressure is also more efficient than a conventional arrangement since many, if not all, of the areas of friction in a pump drive are eliminated.

In common rail diesel engines currently being designed, peak cylinder pressures are generally in the range of 180 to 220 bar and peak injection pressures are generally in the range of 2000 to 2200 bar. It is therefore necessary to have a piston/pumping plunger area ratio of at least 10:1, and possibly 15:1. The principle requirement for the pump in this case is for high pressure but low volume displacement.

It is another advantage of the invention that the actuation force required to lift the outer sleeve 70 from the seat 60 to open the exhaust passage 40 is relatively low as the outer sleeve 70 is exposed to a radial force acting over its internal surface, but only a very limited axial force which makes the valve arrangement convenient for VVA. In many conventional exhaust valve arrangements it is necessary to open the valve inwardly, into the combustion chamber, so that the high pressure within the combustion chamber has to be overcome as the valve is moved axially from its seat, requiring an expensive and robust valve train.

A further advantage of the invention is that, as the piston 72 and the outer sleeve 70 open outwardly from the combustion chamber 12, the flow of exhaust gas past the open valve arrangement into the exhaust passage 40 is not obstructed. In a conventional arrangement, where the exhaust valve opens into the combustion chamber, the valve tends to impede the exhaust gas flow. Thus, it is a further benefit that the cylinder head bore 30 can be machined with a smaller diameter than conventional systems, whilst still allowing the same flow of exhaust gas as would be the case for the conventional arrangement but saving valuable space in the cylinder head.

In the embodiment shown in FIG. 1, the other exhaust valve arrangement of the system (not shown but to the right of the exhaust valve arrangement 50) is of conventional type so that the cut-out 29 in the upper surface of the cylinder piston 26 is required to accommodate the inwardly opening valve (i.e. the valve opens into the combustion chamber 12). However, it will be appreciated that as the piston 72 of the exhaust valve arrangement 50 of the invention opens outwardly from the combustion chamber 12, no cut-out is required in the cylinder piston 26 on the left hand side to accommodate such movement. Clearance cut-outs in the cylinder piston are not desirable because they have a tendency to disrupt in-cylinder air swirl to the detriment of efficient combustion. The present invention therefore offers an advantage in reduced manufacturing cost and improved maintenance of air swirl within the combustion chamber 12.

As the cylinder pressure rises during the compression stroke and fuel or fluid within the pump chamber 77, at this time being in a condition of hydraulic lock, is thereby pressurised, the output signal from the pressure sensor 140 can be used to provide an indication of the combustion chamber pressure. If the area ratio between the piston 72 and the pumping plunger 77 (typically 10:1 or greater) is known, combustion chamber pressure can therefore be calculated from the fuel pressure measurement by the pressure sensor 140. As can be seen in FIG. 8, the pumping event performed by the plunger 73 aligns with the combustion event, as indicated by the departure of the cylinder pressure trace from the dashed line 150 which illustrates a non-firing event.

This method of measuring pressure within the combustion chamber 12 represents an advantage since it avoids the problems associated with conventional cylinder pressure sensors which have to withstand the harsh environment (e.g. high temperature and pressure) of the combustion chamber directly. In the present invention, the pressure sensor 140 can be mounted conveniently on the valve housing 112, outside the combustion chamber 12.

It will be appreciated that, during the power stroke once the rail control valve assembly 116 has been opened to allow communication between the first and second passages 120, 122 (and hence flow between the pump chamber 77 and the rail volume 125), the pressure sensor 140 no longer provides a meaningful indication of combustion chamber pressure. During the intake stroke, boost pressure will typically be tracked by a manifold absolute pressure (MAP) sensor and this signal may be used to confirm the pressure sensor output signal at this time since the piston 72 is also exposed to the same pressure in the combustion chamber 12.

If the invention is implemented in an engine which does not enjoy the benefit of a variable compression ratio mechanism or variable valve timing, and is therefore not able to control effective compression ratio through varying when the intake valves close, it provides a means of influencing the start of combustion in a different way. A small measure of compression ratio control may be implemented as follows.

As combustion chamber pressure rises at the start of the compression stroke, the filling valve assembly 118 is energised briefly to allow the piston 72 to retract and thereby change the volume of the combustion chamber 12. The time period for which the filling valve assembly 118 is open controls the amount of piston movement and, hence, the amount by which the combustion chamber volume is increased. Since this facility to reduce the effective compression ratio is required only while operating in the pre-mixed auto-ignition mode, and therefore only under part load conditions, the full stroke of the piston 72 and the plunger 73 is not required for fuel delivery and so some part of the stroke can be given up to controlling the compression ratio in this way.

In a variation of the aforementioned strategy, the filling valve assembly 118 may be deactivated (closed) early in the intake stroke so that movement of the piston 72 into its rest position is halted early (i.e. before it reaches the position of FIG. 9(*a*)). In this instance the volume of the combustion chamber 12 is slightly higher than its nominal value, which results in a lower geometric compression ratio than for the other cylinders. This capability may therefore also be used to effect some degree of cylinder-to-cylinder compression ratio trim.

Figure 10:
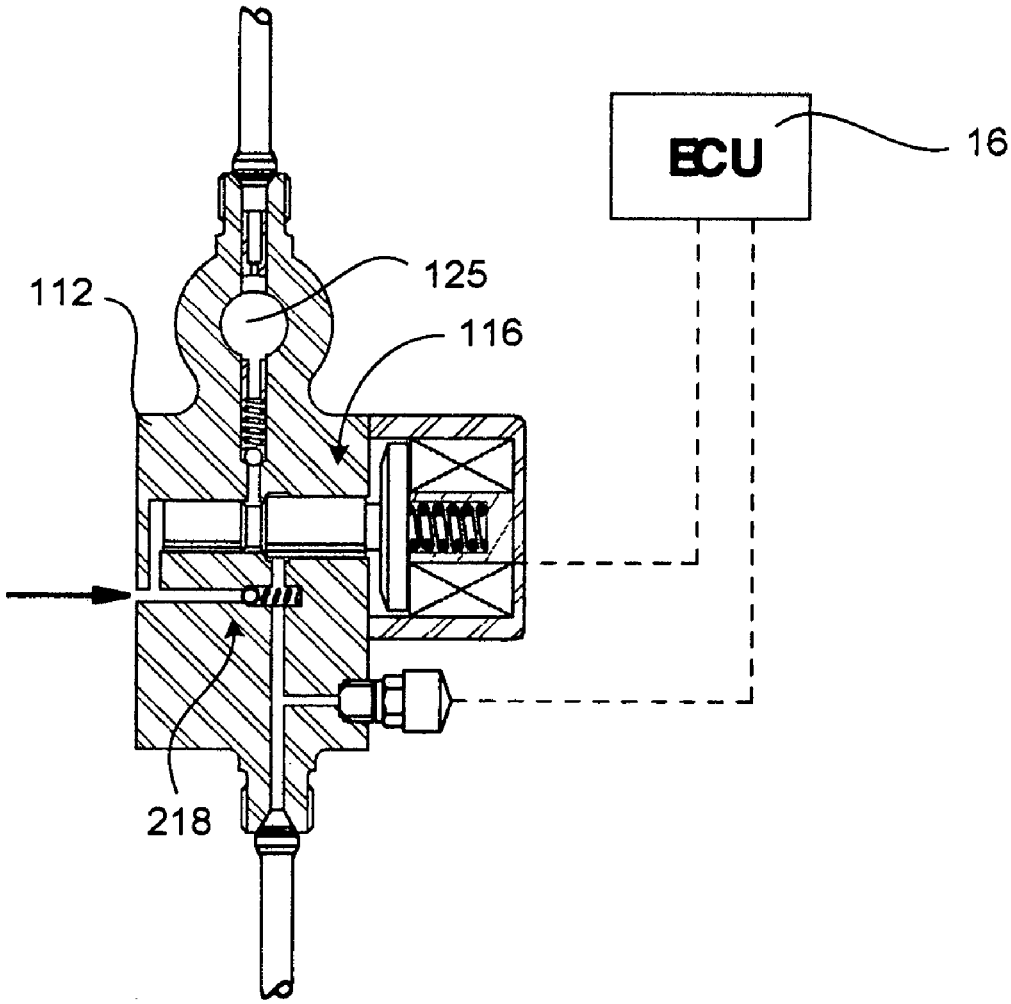
FIG. 10 is a schematic view of an alternative filling valve for the fuel system in FIG. 1.

Referring to FIG. 10, in another embodiment of the invention, the electromagnetically controlled filling valve assembly 118 of the first embodiment is replaced with a spring-controlled filling check valve 218. Although the filling check valve 218 allows the system to have one less actuator, continued satisfactory operation in the event of misfire is not made possible with this embodiment as there is no direct control of the filling valve 218.

In another embodiment of the system (not shown), a valve seat insert is provided for the outer sleeve 70 to replace the seat 60 in FIG. 1. Typically a valve seat insert is not required as the outer sleeve 70 is relatively light (being a tube), and the valve seat loading forces are relatively low due to the sleeve 70 being pressure-balanced. However, if the cylinder head 20 is formed from a light alloy, it may be beneficial to use a valve seat insert of harder material. For example, the valve seat insert may be screwed into the cylinder head bore 30. In this case the valve seat insert would take the form of a tube or sleeve, so that the piston 72 runs in this tube rather than in the cylinder head bore 30 directly.

The exhaust valve arrangement of the invention can be used on engines that operate in a conventional (late injection) diesel injection mode, or those that operate in advanced pre-mixed combustion mode (e.g. HCCI), or multiple mode engines (typically premixed at part load and conventional at high load). When operating in premixed combustion modes in particular, it is helpful to estimate the likely timing of combustion. With the present invention, this can be deduced using the cylinder pressure that is determined from the output of the pressure sensor 140 and the position of the cylinder piston 26. Together with knowledge of boost pressure, temperature, humidity and the gas constituents of the combustion chamber, conditions at or near TDC can be determined and, hence, the likely timing of combustion can be estimated even if cool-flame reactions are not present.

Figure 11:
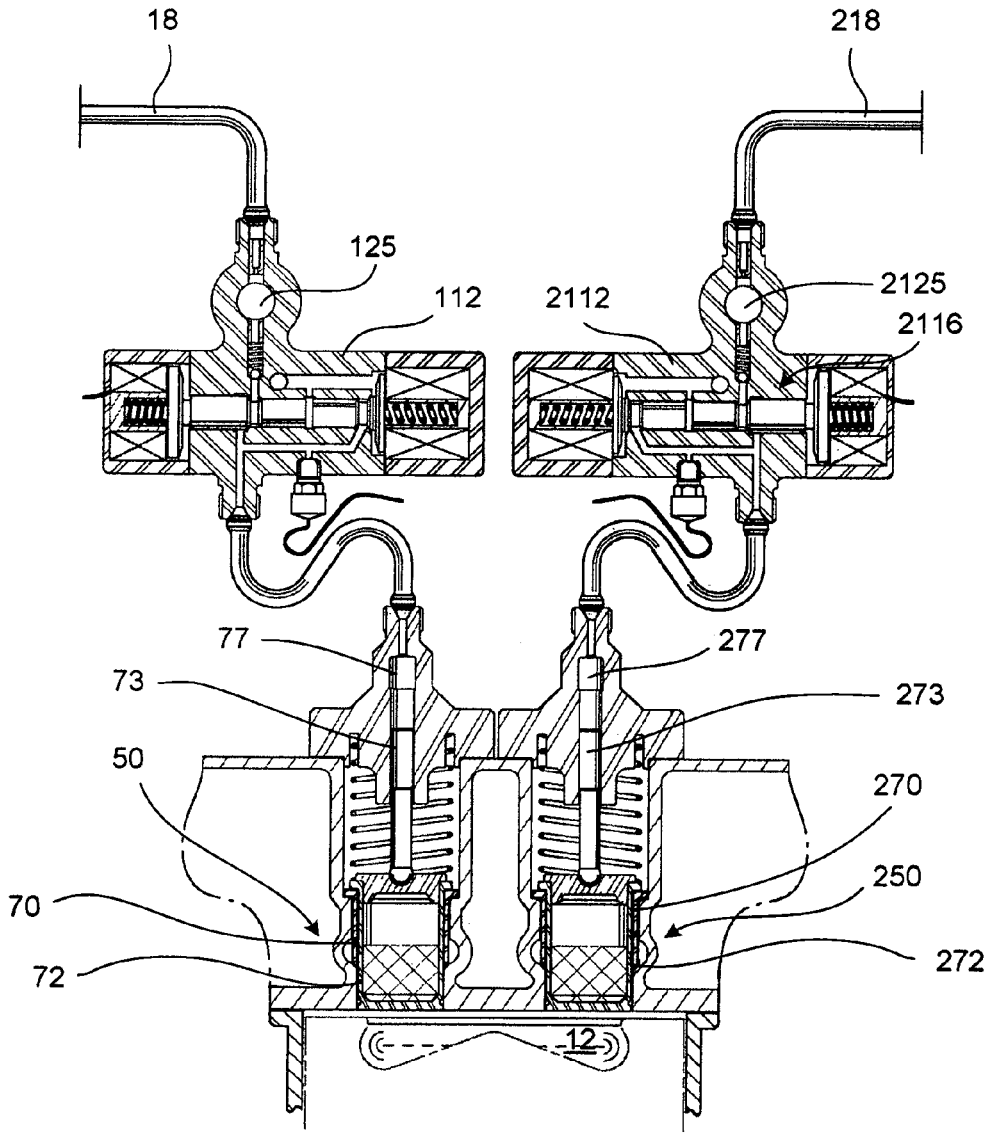
FIG. 11 is a schematic view of a fuel system of an alternative embodiment of the invention, comprising first and second exhaust valve arrangements.

In other embodiments of the invention, rather than the second exhaust valve arrangement being a conventional, inwardly opening type, a second outwardly opening exhaust valve arrangement may be used. FIG. 11 is a particular example of a fuel system having two outwardly opening exhaust valve arrangements 50, 250 on one cylinder, each of which is used to charge individual accumulator volumes 125, 2125, respectively. Like parts to those shown in FIG. 1 for the first exhaust valve arrangement 50 are identified with like reference numerals, and corresponding parts of the second exhaust valve arrangement 250 are denoted with like reference numerals preceded by numeral 2. Both of the exhaust valve arrangements 50, 250 take a similar form to that shown in FIG. 1, including a piston 72, 272 which is moveable within an outer sleeve 70, 270 and the piston 72, 272 coupled to a pumping plunger 73, 273.

In embodiments where at least two exhaust valve arrangements 50, 250 are incorporated into an engine cylinder head, it is contemplated that they may be used in a multiplicity of ways to fuel the engine and/or support engine functions, depending upon intent, as discussed below.

In one embodiment, for example, the resulting fluid pressure for the second exhaust valve arrangement 250 may be used for an electro-hydraulic VVA system and/or a hydraulically assisted turbo-charger. For the electro-hydraulic VVA system and/or the hydraulically assisted turbo-charger, a reduced hydraulic pressure is required relative to that required for the fuel injection system so that the piston/pumping plunger area ratio may be lower, for example 5:1, for the second exhaust valve arrangement, resulting in a higher volumetric fluid flow rate. In the case of the electro-hydraulic VVA system at least, if not the hydraulic assisted turbo-charger application, the preferred fluid used would be diesel fuel. With a fuel rail at, for example, 250 bar, this could also then be available as a source of fuel for multiple injections into the combustion chamber 12 during the compression stroke under premixed combustion operation, or for other operations such as post injection or injections into the exhaust system for re-generation of an after treatment device of the engine (after treatment generation). In this embodiment diesel fuel would be used to fill both rail volumes but at two different pressures. An example of such a system is described in the Applicant's patent U.S. Pat. No. 7,037,349.

In another example, the pumping plunger 273 for the second exhaust valve arrangement 250 may be used to pressurise fuel for supply to the same rail volume 125 as the first exhaust valve arrangement 50 (i.e. for injection to the combustion chamber 12).

In a further embodiment the second exhaust valve arrangement 250 of FIG. 11 may be used to pressurise a fuel other than diesel. The concept of using bi-fuel or dual fuel engines is known, with the engines being configured to operate on either one or the other fuel at the drivers command, typically depending on fuel availability. One example is systems which are engineered to run on either gasoline or ethanol, or systems which have two separate fuel systems and can run on compressed natural gas or gasoline. The term dual fuel is used here to refer to an engine which uses two fuels at once, one example being compressed natural gas (CNG) engines that require a pilot injection of diesel fuel as the ignition source (referred to as diesel-CNG). By way of example, a dual fuel system is described in U.S. Pat. No. 5,996,558.

If both valve arrangements are used for pressurizing fuel for combustion in the combustion chamber 12, the fuels may be the same, for example diesel fuel (as described previously), or they may be two different fuels, for example a non-reactive compression ignition fuel such as liquid propane gas (LPG) and a reactive compression ignition fuel such as dimethyl-ether (DME) at appropriate pressures. In this case, the engine would be largely fuelled by the non-reactive fuel, but the combustion event would be initiated by a small injection of the reactive fuel at the appropriate time typically close to TDC. In another embodiment, the two valve arrangements may represent separate fuel injection systems by which the engine may be fuelled independently depending on the availability of fuel at that time.

In a still further embodiment, the plungers 73, 273 in FIG. 11 may be arranged to pressurise fuel for supply to a common accumulator volume (e.g. common rail) which is then provided to a plurality of fuel injectors of the engine.

The maximum lift of the piston of each valve arrangement is determined by the position of the housing 31 within the bore 30 of the cylinder head 20. If the required change in combustion chamber volume to effect the desired reduction in cylinder pressure dp/dt is 15%, for example, having two exhaust valve arrangements of the outwardly opening type would allow for each piston to have a reduced stroke (i.e. to give half the required volume displacement each) compared to a system in which only a single outwardly opening exhaust valve arrangement is provided. Additionally, in such an arrangement in which the piston 72 operates with a reduced stroke, it will be appreciated that the annulus 64, and thus the inlet to the exhaust passage 40, must be situated closer to the fire deck 22 than is illustrated in the figures described previously.

In a still further embodiment the system may be simplified by removing the communication path in FIG. 1 between the pump chamber 77 and the injector 14 so that fuel that is pressurised as a result of the piston 72 moving the plunger 73 is not used for injection purposes but is simply returned to a low pressure drain under the control of an appropriate valve. In this way the pressure spikes occurring as a result of the combustion process are still absorbed by the movement of the piston 72 and the plunger 73, but the energy generated as a result is not harnessed.

Figure 12:
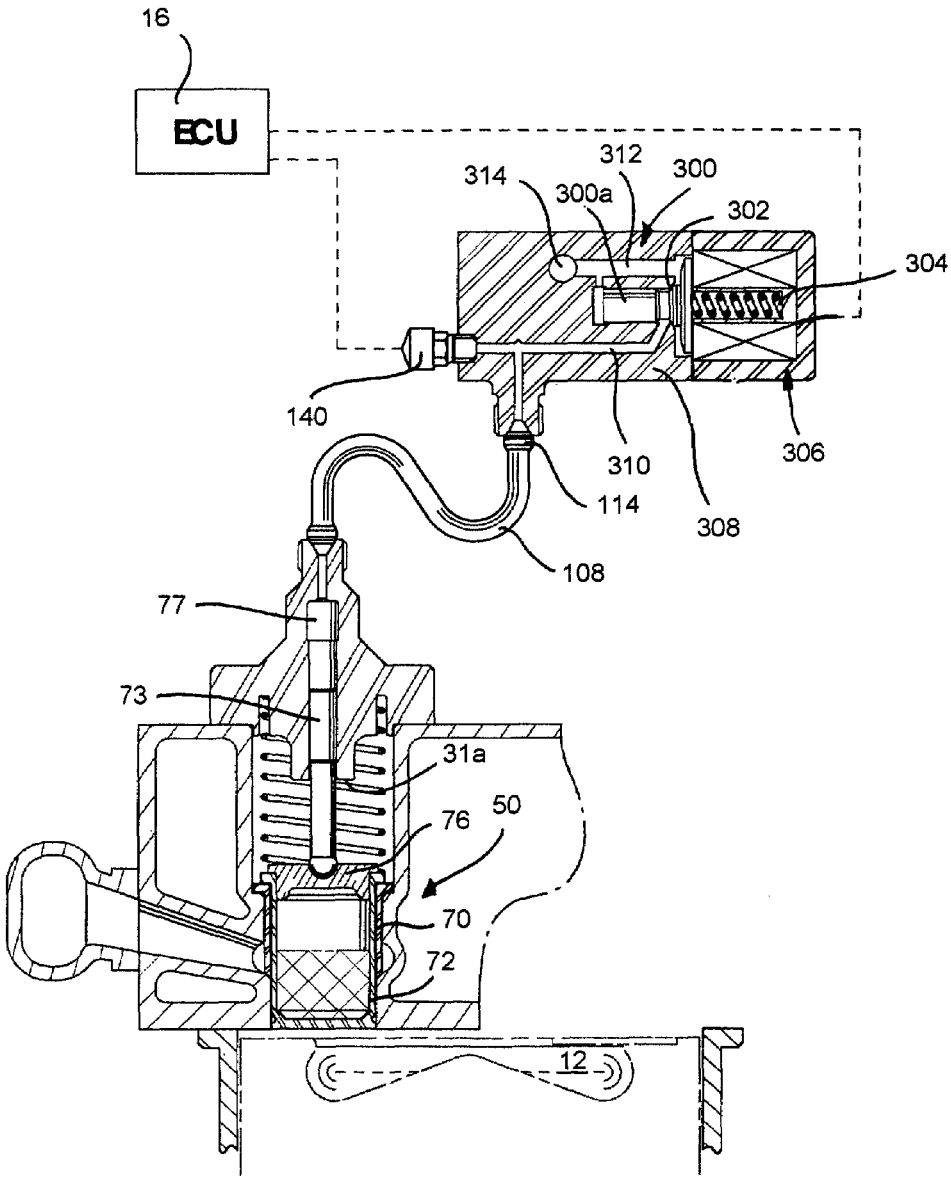
FIG. 12 is a schematic view of a fuel system of a further alternative embodiment of the invention.

An example of this arrangement is shown in FIG. 12, where like parts to those shown in previous embodiments are denoted with like reference numerals. The rail control valve assembly 116 and the filling valve assembly 118 in FIG. 1 are removed and are replaced by a pressure balanced 2-way valve assembly 300 comprising a valve pin 300*a* which is biased into engagement with a valve seat 302 by means of a spring 304. The valve pin 300*a* is movable away from the valve seat 302 by means of an actuator 306 which is controlled by the ECU 16. The valve components are housed within a valve housing 308 defining a first passage 310 and a second passage 312, the latter being in communication with a filling gallery 314 for low pressure fuel. The valve pin 300*a* is movable towards and away from the valve seat 302 to control whether the first passage 310 communicates with the second passage 312.

In operation, the outer sleeve 70, the piston 72 and the plunger 73 all behave as described previously. Just prior to combustion, the valve assembly 300 is actuated to open communication between the first and second passages 310, 312, allowing pressurised fuel within the pump chamber 77 to be discharged into the filling gallery 314 as the piston 72 responds to the rapid increase in cylinder pressure. As before, to prevent severe impact of the cap 76 of the valve piston 72 against its stop 31*a*, the valve assembly 300 may be deactivated early so as to arrest movement of the piston 72 by hydraulic lock. The valve assembly 300 is then activated again during the filling phase to recharge the pump chamber 77 with low pressure fuel from the filling gallery 314 as the plunger 73 is retracted. A fluid other than fuel may be used in the pump chamber 77, if desired.

A modification (not shown) of FIG. 12 replaces the 2-way valve assembly with a 3-way valve assembly. Another modification (not shown) replaces the balanced valve pin 300*a* with an unbalanced valve pin.

It will be appreciated that the various aspects of the invention described here are not limited to application in the specific engines described, and may be applicable, for example, to any of spark ignition, compression ignition, pulse-detonation, 2-stroke, 4-stroke and/or single or multiple cylinder engines operating on any fuel.

The invention claimed is:

1. An exhaust valve arrangement for use in a combustion chamber of a compression ignition internal combustion engine, the exhaust valve arrangement including:

a piston that is movable outwardly from a combustion chamber in response to pressure generated within the combustion chamber as a result of combustion, and an outer sleeve, within which the piston is movable, wherein the outer sleeve is actuable between open and closed positions to open and close, respectively, an exhaust passage from the combustion chamber, wherein the outer sleeve has an actuator for moving the outer sleeve from the closed position into the open position, further comprising a pump chamber for receiving fluid, wherein a surface associated wit the piston defines a wall of the pump chamber so that the piston pressurises fluid within the pump chamber as the piston is urged outwardly from the combustion chamber.

2. The exhaust valve arrangement as claimed in claim 1, further comprising a biasing arrangement for urging the piston into a position in which the piston holds the outer sleeve in the closed position to close the exhaust passage.

3. The exhaust valve arrangement as claimed in claim 2, wherein the biasing arrangement includes a piston spring for urging the piston into a position in which the piston holds the outer sleeve in the closed position.

4. The exhaust valve arrangement as claimed in claim 2, wherein the biasing arrangement includes a gas or fluid pressure for urging the piston into the position in which the piston holds the outer sleeve in the closed position.

5. The exhaust valve arrangement as claimed in claim 1, wherein the piston is hollow.

6. The exhaust valve arrangement as claimed in claim 5, wherein the piston is at least partially filled with a medium for aiding heat transfer away from a surface of the piston that is exposed to gases within the combustion chamber.

7. The exhaust valve arrangement as claimed in claim 1, wherein the piston includes a main piston body in the form of a cup and a piston cap which closes the cup.

8. The exhaust valve arrangement as claimed in claim 1, wherein the piston is coupled to a pumping plunger which defines the wall of the pump chamber, the pumping plunger being movable wit the piston in response to pressure generated within the combustion chamber so as to pressurise fluid within the pump chamber.

9. An exhaust valve arrangement for use in a combustion chamber of a compression ignition internal combustion engine, the exhaust valve arrangement including:

a piston which is movable outwardly from the combustion chamber in response to pressure generated within the combustion chamber as a result of combustion, an outer sleeve within which the piston is movable, wherein the outer sleeve is operable between open and closed positions to open and close, respectively, an exhaust passage from the combustion chamber, a pump chamber for receiving fluid, and a pumping plunger coupled to the piston and movable with the piston in response to pressure generated within the combustion chamber so as to pressurise fluid within the pump chamber as the piston is urged outwardly from the combustion chamber.

10. The exhaust valve arrangement as claimed in claim 9, wherein the piston is at least partially filled with a medium for aiding heat transfer away from a surface of the piston that is exposed to gases within the combustion chamber.

11. A fuel system for a compression ignition internal combustion engine, the fuel system including;

an exhaust valve arrangement for the combustion chamber as timed in claim 9, and a valve assembly for controlling the supply of fluid to and from the pump chamber, whereby the valve assembly is operable to allow pressure spikes within the combustion chamber to be absorbed by movement of the plunger.

12. The fuel system as claimed in claim 11, further comprising:

at least one fuel injector for delivering fuel into the combustion chamber, and an accumulator volume for receiving fluid in the form of fuel that is pressurised within the pump chamber and for storing said fuel for delivery to the or each injector.

13. The fuel system as claimed in claim 12, wherein the valve assembly comprises a rail control valve for controlling communication between the pump chamber and the accumulator volume.

14. The fuel system as claimed in claim 13, wherein the rail control valve is operable by means of an electromagnetic actuator.

15. The fuel system as claimed in claim 14, including a sensor for sensing the pressure in the pump chamber, whereby the rail control valve is actuated to open communication between the pump chamber and the accumulator volume in response to the sensed pressure.

16. The fuel system as claimed in claim 15, wherein the rail control valve is pressure balanced with respect to fuel pressure within the pump chamber that is applied to the rail control valve.

17. The fuel system as claimed in claim 13, wherein the valve assembly further comprises a non-return valve between the rail control valve and the accumulator volume.

18. The fuel system as claimed in claim 13, wherein the valve assembly further comprises a filling valve for controlling the supply of low pressure fuel to the pump chamber.

19. The fuel system as claimed in claim 18, wherein the filling valve is an actuable valve which is controllable by an engine control unit.

20. The fuel system as claimed in claim 19, wherein the filling valve is actuable by means of an electromagnetic actuator.

21. The fuel system as claimed in claim 18, wherein the filling valve is a spring-biased non-return valve.

22. The fuel system as claimed in claim 18, wherein at least a portion of the rail control valve and at least a portion of the filling valve are both movable within a common bore formed in a valve housing.

23. A fuel system for a compression ignition internal combustion engine, the fuel system including;

at least one fuel injector for delivering fuel into the combustion chamber, and first and second exhaust valve arrangements, each of which includes an associated piston which is movable outwardly from the combustion chamber in response to pressure generated within the combustion chamber as a result of combustion.

an outer sleeve within which the associated piston is movable, wherein the outer sleeve is operable between open and closed positions to open and close, respectively, an exhaust passage from the combustion chamber, an associated pump chamber for receiving fluid, and a pumping plunger coupled to the associated piston and movable wit the associated piston so as to pressurise fluid within the pump chamber as the associated piston is urged outwardly from the combustion chamber.

24. The fuel system as claimed in claim 23, wherein the pump chamber of the first exhaust valve arrangement is arranged to receive fuel and to deliver pressurised fuel to a first accumulator volume from where fuel is delivered to the at least one injector.

25. The fuel system as claimed in claim 23, wherein the second exhaust valve arrangement is arranged to receive a fluid other than fuel and the associated pumping plunger of the second exhaust valve arrangement is arranged to pressurise the fluid in response to movement of the associated piston and to deliver the pressurised fluid to the associated accumulator volume.

26. The fuel system as claimed in claim 25, whereby fluid within the associated accumulator volume of the second exhaust valve arrangement is delivered to an engine system.

27. The fuel system as claimed in claim 26, wherein the engine system is at least one of:

an electro-hydraulic variable valve actuation system, a hydraulically assisted turbo-charger, an intensifier piston for pressurising injectable fuel.

28. The fuel system as claimed in claim 24, wherein the associated pump chamber of the second exhaust valve arrangement is arranged to receive fuel and the associated pumping plunger of the second exhaust valve arrangement is arranged to pressurise said fuel in response to movement of the associated piston of the second exhaust valve arrangement.

29. The fuel system as claimed in claim 28, wherein the associated pump chamber of the second exhaust valve arrangement is arranged to deliver the pressurised fuel to the associated accumulator volume of the second exhaust valve arrangement from where fuel is provided to the at least one injector.

30. The fuel system as claimed in claim 29, wherein the accumulator volume of the first exhaust valve arrangement is the same as the accumulator volume of the second exhaust valve arrangement so as to form a common accumulator volume for fuel to be provided to a plurality of injectors of the engine.

31. The fuel system as claimed in claim 29, wherein, in the first exhaust valve arrangement, an area ratio of the piston to the pumping plunger is greater than an area ratio of the piston to the pumping plunger in the second exhaust valve arrangement.

32. The fuel system as claimed in claim 31, wherein the associated accumulator volume of the second exhaust valve arrangement is arranged to deliver pressurised fuel for the purpose of at least one of the following:

an early premixed injection, a pilot injection, a post injection, a late post injection, an after treatment regeneration injection.

* * * * *